US008795011B2

(12) United States Patent
Takase et al.

(10) Patent No.: US 8,795,011 B2
(45) Date of Patent: Aug. 5, 2014

(54) MARINE VESSEL PROPULSION APPARATUS

(75) Inventors: Hiroaki Takase, Shizuoka (JP); Takashi Kimura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 230 days.

(21) Appl. No.: 13/212,247

(22) Filed: Aug. 18, 2011

(65) Prior Publication Data

US 2012/0094558 A1 Apr. 19, 2012

(30) Foreign Application Priority Data

Oct. 13, 2010 (JP) ..... 2010-230851

(51) Int. Cl.
*B63H 20/10* (2006.01)

(52) U.S. Cl.
USPC ..... 440/58; 440/59; 440/60; 440/61 R

(58) Field of Classification Search
USPC ..... 440/61 S–61 C, 58–60; 114/144 E
See application file for complete search history.

(56) References Cited

U.S. PATENT DOCUMENTS 6,146,220 A 11/2000 Alby et al.
6,183,321 B1 2/2001 Alby et al.
6,402,577 B1 6/2002 Treinen et al.
7,244,152 B1 7/2007 Uppgard
7,267,587 B2 * 9/2007 Oguma et al. ..... 440/58
7,930,987 B2 * 4/2011 Mizutani ..... 114/144 RE

OTHER PUBLICATIONS

Takase et al.; "Marine Vessel Propulsion Apparatus"; U.S. Appl. No. 13/212,256, filed Aug. 18, 2011.
Takase; "Marine Vessel Propulsion Apparatus"; U.S. Appl. No. 13/212,258, filed Aug. 18, 2011.
Kimura et al., "Suspension Device for Outboard Motor and Vessel Propulsion Apparatus," U.S. Appl. No. 13/732,555, filed Jan. 2, 2013.
Kadobayashi et al., "Suspension Device for Outboard Motor and Vessel Propulsion Apparatus", U.S. Appl. No. 13/732,559, filed Jan. 2, 2013.

* cited by examiner

*Primary Examiner* — Edwin Swinehart
(74) *Attorney, Agent, or Firm* — Keating & Bennett, LLP

(57) ABSTRACT

A marine vessel propulsion apparatus includes a transom bracket, a steering shaft, an outboard motor, a tilt mechanism, and a steering mechanism. The steering shaft is joined to the transom bracket, and is turnable around a steering axis extending in an up-down direction. The outboard motor is joined to the steering shaft, turnable around a tilt axis, and turnable around the steering axis together with the steering shaft. The tilt mechanism is arranged to turn the outboard motor around the tilt axis with respect to the steering shaft. The steering mechanism includes a power conversion mechanism arranged to convert power of the electric motor into turning of the steering shaft around the steering axis.

21 Claims, 31 Drawing Sheets

MARINE VESSEL PROPULSION APPARATUS

BACKGROUND OF THE INVENTION

1. Field of the Invention

The present invention relates to a marine vessel propulsion apparatus.

2. Description of the Related Art

A conventional marine vessel propulsion apparatus is described in, for example, U.S. Pat. No. 6,402,577. This marine vessel propulsion apparatus includes a transom bracket, a steering shaft, an outboard motor, a tilt mechanism, and a steering mechanism.

The transom bracket attachable to the transom of a hull is joined to the steering shaft. The steering shaft is turnable around a steering axis extending in the up-down direction with respect to the transom bracket. The outboard motor joined to the steering shaft is turnable around a tilt axis extending in the horizontal direction with respect to the steering shaft. The outboard motor and the steering shaft are turnable around the steering axis with respect to the transom bracket.

The tilt mechanism turns the outboard motor around the tilt axis with respect to the steering shaft. The steering mechanism turns the outboard motor and the steering shaft around the steering axis with respect to the transom bracket. The steering mechanism described in U.S. Pat. No. 6,402,577 is a hydraulic steering mechanism including a hydraulic pump. By driving the hydraulic pump, a hydraulic pressure is generated and this hydraulic pressure turns the outboard motor around the steering axis.

The steering mechanism described in U.S. Pat. No. 6,402,577 includes a steering arm and a steering actuator. The steering actuator includes a housing (a first portion of the steering actuator) and a rod (a second portion of the steering actuator). The housing and the rod extend in the right-left direction. The rod is disposed inside the housing. The housing has two cavities (hollows) disposed on the lateral sides of the right end portion and the left end portion of the rod. Hydraulic oil is supplied to these two cavities. The cavities are filled with the hydraulic oil. When a difference in hydraulic pressure is caused between the two cavities, the rod moves in the right-left direction inside the housing.

The rod is attached to the steering arm. The steering arm is attached to the outboard motor. When a difference in hydraulic pressure is caused between the two cavities and the rod moves in the right-left direction, the steering arm turns around the steering axis at a turning angle corresponding to a movement distance of the rod. When the steering arm further turns around the steering axis, the outboard motor turns around the steering axis together with the steering arm. Therefore, when the rod moves in the right-left direction, the outboard motor turns around the steering axis at a turning angle corresponding to the movement distance of the rod.

SUMMARY OF THE INVENTION

The inventors of preferred embodiments of the present invention described and claimed in the present application conducted an extensive study and research regarding a marine vessel propulsion apparatus, such as the one described above, and in doing so, discovered and first recognized new unique challenges and previously unrecognized possibilities for improvements as described in greater detail below.

In a hydraulic steering mechanism, a hydraulic pump is driven in response to a steering command to turn the outboard motor around the steering axis. Therefore, in order to maintain excellent responsiveness, the hydraulic pump must be driven even when the outboard motor is not turned around the steering axis. However, when the hydraulic pump is driven even in the case where the steering mechanism is not used, energy loss increases. A power source (electric motor) to drive the hydraulic pump uses power generated by an engine, and as a result, this also influences fuel consumption.

Further, in the steering mechanism described in U.S. Pat. No. 6,402,577, two cavities are disposed on the left and right of the rod, so that the width (length in the right-left direction) of the steering mechanism is wide. Moreover, the outboard motor turns around the steering axis at a turning angle corresponding to the movement distance of the rod, so that in order to increase the maximum turning angle of the outboard motor around the steering axis, it is necessary to increase the maximum movement distance of the rod by increasing the width of the housing that houses the rod. Therefore, if the maximum turning angle of the outboard motor around the steering axis is increased, the width of the steering mechanism further increases.

In order to overcome the previously unrecognized and unsolved challenges described above, a preferred embodiment of the present invention provides a marine vessel propulsion apparatus including a transom bracket, a steering shaft, an outboard motor, a tilt mechanism, and a steering mechanism. The transom bracket is arranged to be attachable to a transom of a hull. The steering shaft is joined to the transom bracket, and arranged to turn around the steering axis extending in an up-down direction. The outboard motor is joined to the steering shaft. The outboard motor is arranged to turn around the tilt axis extending along a plane that is perpendicular or substantially perpendicular to the steering axis. Further, the outboard motor is arranged to turn around the steering axis together with the steering shaft. The tilt mechanism is joined to the steering shaft and the outboard motor, and arranged to turn the outboard motor around the tilt axis with respect to the steering shaft. The steering mechanism includes an electric motor and a power conversion mechanism. The power conversion mechanism is arranged to convert power of the electric motor turning of the steering shaft around the steering axis.

With this arrangement of the present preferred embodiment of the present invention, the steering mechanism includes an electric motor and a power conversion mechanism. Specifically, the steering mechanism is an electric steering mechanism including an electric motor. The electric motor is driven by electric power. Power of the electric motor is converted into turning of the steering shaft around the steering axis by the power conversion mechanism. The outboard motor and the steering shaft are turnable around the steering axis with respect to the transom bracket. Therefore, by converting the power of the electric motor into turning of the steering shaft around the steering axis, the outboard motor turns around the steering axis with respect to the transom bracket. Accordingly, the marine vessel is steered.

In the electric steering mechanism, the time lag between a steering command to turn the outboard motor around the steering axis and turning of the outboard motor is smaller than that in a hydraulic steering mechanism. Therefore, when the outboard motor is not turned around the steering axis, it is not necessary to drive the electric motor. Therefore, as compared with a marine vessel propulsion apparatus including a hydraulic steering mechanism, energy loss can be reduced. The electric steering mechanism can control the stop position of the outboard motor and the turning angle of the outboard motor with accuracy higher than that of the hydraulic steering mechanism. Further, the electric steering mechanism does not need a hydraulic pump and a tank, etc., so that as compared with a marine vessel propulsion apparatus including a hydraulic steering mechanism, the steering mechanism can be decreased in size.

The transom bracket includes a tubular housing portion extending along the steering axis, and at least a portion of the steering shaft may be housed in the housing portion. In this case, the steering shaft is reliably held by the transom bracket.

The steering mechanism may include a reduction gear mechanism arranged to decelerate rotation of the electric motor and transmit the decelerated rotation to the power conversion mechanism. In this case, by decelerating the rotation of the electric motor by the reduction gear mechanism, the power of the electric motor is amplified. Accordingly, the steering mechanism does not require a large-sized electric motor that outputs high power. Accordingly, the marine vessel propulsion apparatus can be decreased in size.

The electric motor may be arranged so as not to turn around the steering axis with respect to the transom bracket according to turning of the outboard motor around the steering axis, and the electric motor may be arranged so as not to turn around the tilt axis with respect to the transom bracket according to turning of the outboard motor around the tilt axis.

Further, the electric motor may be arranged to change a position of the electric motor with respect to the outboard motor according to turning of the outboard motor around the steering axis, and may be arranged to change the position of the electric motor with respect to the outboard motor according to turning of the outboard motor around the tilt axis.

The electric motor may be fixed to the transom bracket. In detail, the electric motor may be fixed to the transom bracket via an intermediate member, or may be directly fixed to the transom bracket.

The power conversion mechanism may include a first conversion mechanism arranged to convert rotation of the electric motor into linear motion, and a second conversion mechanism arranged to convert the linear motion into turning of the steering shaft around the steering axis with respect to the transom bracket.

The first conversion mechanism may include a first ball screw joined to the transom bracket and the electric motor, the first ball screw driven to rotate by the electric motor, and a first ball nut attached to the first ball screw. In this case, the second conversion mechanism may include a first rack joined to the first ball nut, and a first pinion engaged with the first rack, the first pinion joined to the steering shaft so as to turn around the steering axis together with the steering shaft. The rotation of the electric motor is converted into linear motion of the first ball nut with respect to the first ball screw by the first ball screw and the first ball nut, and the linear motion of the first ball nut is converted into turning of the steering shaft by the first rack and the first pinion.

The first conversion mechanism may include a first ball screw joined to the transom bracket and the electric motor the first ball screw driven to rotate by the electric motor, and a first ball nut attached to the first ball screw. In this case, the second conversion mechanism may include a first pin joined to the first ball nut and a first arm joined to the first pin and the steering shaft, and the first conversion mechanism may be arranged to convert linear motion of the first ball nut with respect to the first ball screw into turning of the steering shaft by the first pin and the first arm. The rotation of the electric motor is converted into linear motion of the first ball nut with respect to the first ball screw by the first ball screw and the first ball nut, and the linear motion of the first ball nut is converted into turning of the steering shaft by the first pin and the first arm.

The power conversion mechanism may include a first drive gear joined to the transom bracket and the electric motor, the first drive gear being driven to rotate by the electric motor, and a first driven gear engaged with the first drive gear, the first driven gear being joined to the steering shaft so as to turn around the steering axis together with the steering shaft.

The first drive gear may be arranged to be driven to rotate by the electric motor around a first non-crossing axis that is parallel or substantially parallel to the steering axis and does not cross the steering axis, and the first driven gear may have a first central axis positioned on the steering axis and may be arranged to turn around the first central axis.

The first drive gear may be arranged to be driven to rotate by the electric motor around a first crossing axis crossing the steering axis, and the first driven gear may have a first central axis positioned on the steering axis, and may be arranged to turn around the first central axis.

The electric motor may be arranged to turn around the steering axis with respect to the transom bracket according to turning of the outboard motor around the steering axis, and the electric motor may be arranged so as not to turn around the tilt axis with respect to the transom bracket according to turning of the outboard motor around the tilt axis.

The electric motor may be arranged so as not to change a position of the electric motor with respect to the outboard motor according to turning of the outboard motor around the steering axis, and arranged to change the position of the electric motor with respect to the outboard motor according to turning of the outboard motor around the tilt axis.

The electric motor may be fixed to the steering shaft. In detail, the electric motor may be fixed to the steering shaft via an intermediate member, or may be directly fixed to the steering shaft.

The first conversion mechanism may include a second ball screw joined to the steering shaft and the electric motor, the second ball screw driven to rotate by the electric motor, and a second ball nut attached to the second ball screw. In this case, the second conversion mechanism may include a second rack joined to the second ball nut, and a second pinion engaged with the second rack, the second pinion joined to the transom bracket, and the first conversion mechanism may be arranged to convert linear motion of the second ball screw with respect to the second ball nut into turning of the steering shaft by the second rack and the second pinion. The rotation of the electric motor is converted into linear motion of the second ball screw with respect to the second ball nut by the second ball screw and the second ball nut, and the linear motion of the second ball screw is converted into turning of the steering shaft by the second rack and the second pinion.

The first conversion mechanism may include a second ball screw joined to the steering shaft and the electric motor, the second ball screw being driven to rotate by the electric motor, and a second ball nut attached to the second ball screw. In this case, the second conversion mechanism may include a second pin joined to the second ball nut, and a second arm joined to the second pin and the transom bracket, and the first conversion mechanism may be arranged to convert linear motion of the second ball screw with respect to the second ball nut into turning of the steering shaft by the second pin and the second arm. The rotation of the electric motor is converted into linear motion of the second ball screw with respect to the second ball nut by the second ball screw and the second ball nut, and the linear motion of the second ball screw is converted into turning of the steering shaft by the second pin and the second arm.

The power conversion mechanism may include a second drive gear joined to the steering shaft and the electric motor, the second drive gear being driven to rotate by the electric motor, and a second driven gear engaged with the second drive gear, the second driven gear being joined to the transom bracket.

The second drive gear may be arranged to be driven to rotate by the electric motor around a second non-crossing axis that is parallel or substantially parallel to the steering axis and does not cross the steering axis, and the second driven gear may have a second central axis positioned on the steering axis. In this case, the rotation of the electric motor is converted into turning of the second drive gear around the second central axis by the second drive gear and the second driven gear.

The second drive gear may be arranged to be driven to rotate by the electric motor around a second crossing axis crossing the steering axis, and the second driven gear may have a second central axis positioned on the steering axis. In this case, the rotation of the electric motor is converted into turning of the second drive gear around the second central axis by the second drive gear and the second driven gear.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a first marine vessel propulsion apparatus including an electric motor fixed to the transom bracket and a second marine vessel propulsion apparatus including an electric motor fixed to the steering shaft will be described. The description given below is based on a state in which the outboard motor is in a reference posture. The reference posture is a posture of the outboard motor when the tilting angle of the outboard motor is zero and the steering angle of the outboard motor is zero. The tilting angle of the outboard motor is an angle of the rotational axis (crank axis L1) of the crankshaft with respect to a vertical plane. The tilting angle of the outboard motor 2 when the crank axis L1 extends vertically is zero. The steering angle of the outboard motor is an angle of the rotational axis (rotational axis L2) of the propeller with respect to the center line of the hull. The steering angle of the outboard motor when the rotational axis L2 of the propeller extends in the front-rear direction is zero. A direction toward one side of the front-rear direction (forward direction) is a direction approaching the transom, and the other direction of the front-rear direction (rearward direction) is a direction extending away from the transom.

First Marine Vessel Propulsion Apparatus

First Preferred Embodiment

Figure 1:
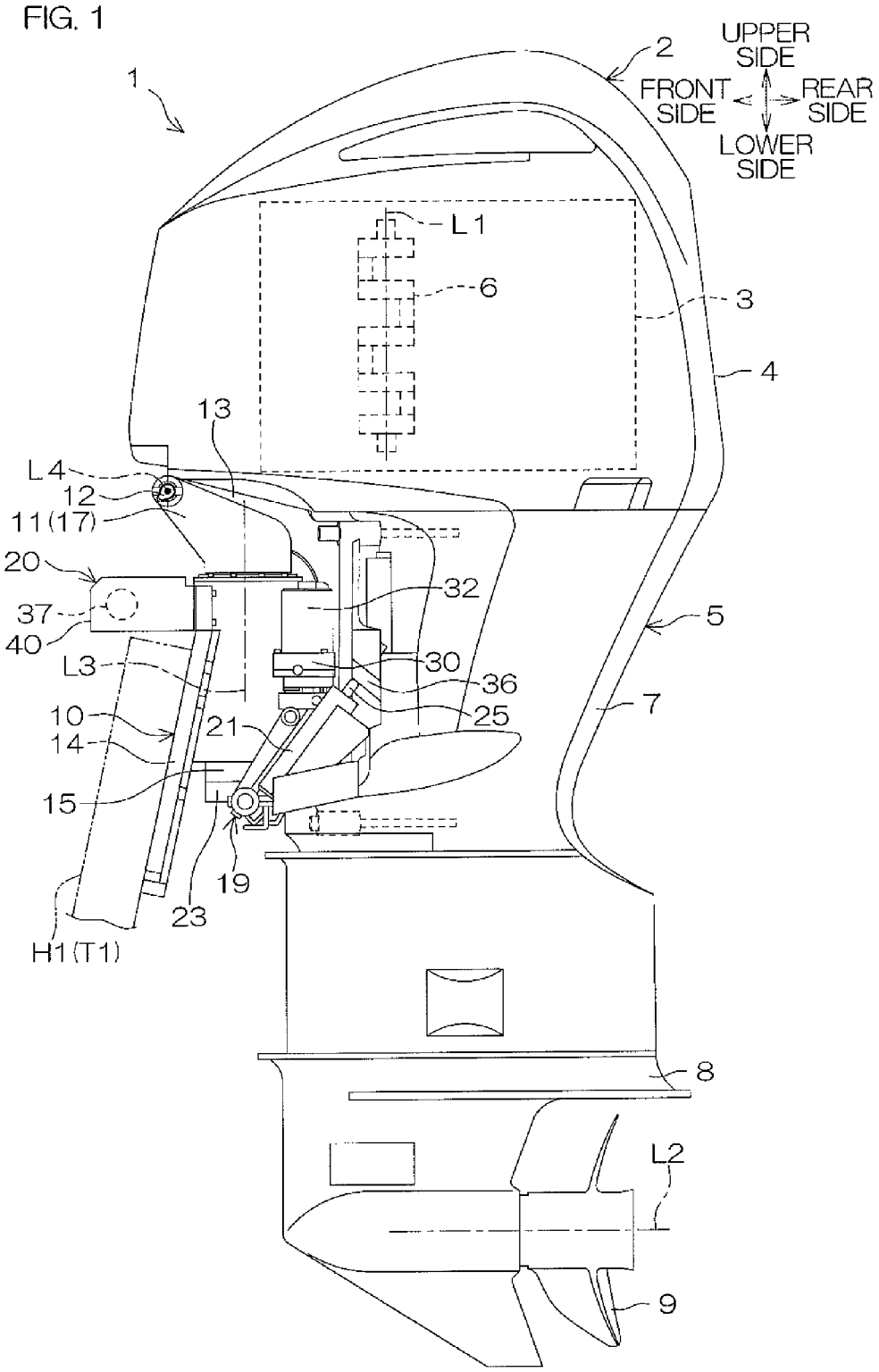
FIG. 1 is a side view of a first marine vessel propulsion apparatus according to a first preferred embodiment of the present invention.
Figure 2:
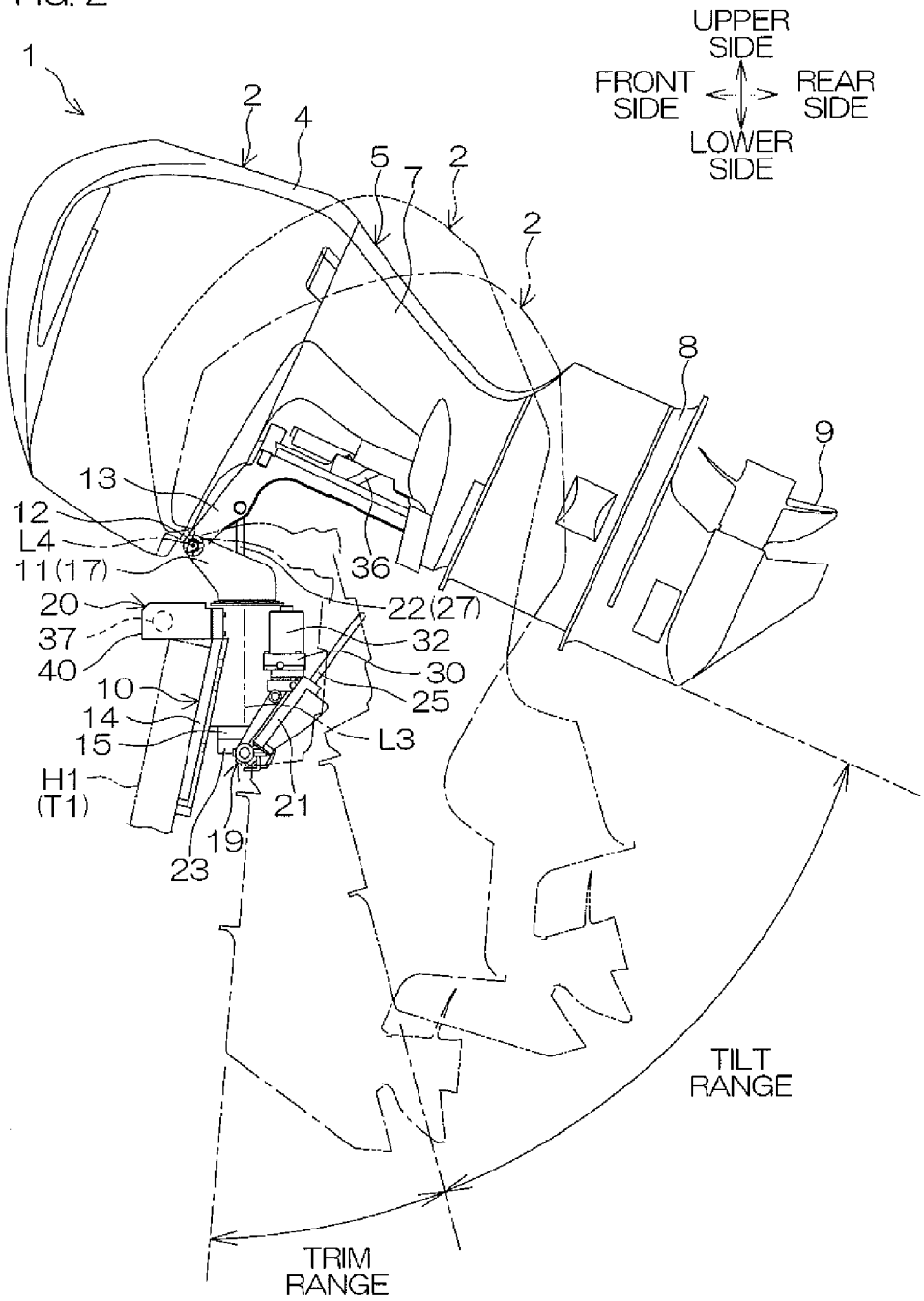
FIG. 2 is a side view of the first marine vessel propulsion apparatus according to the first preferred embodiment of the present invention.
Figure 3:
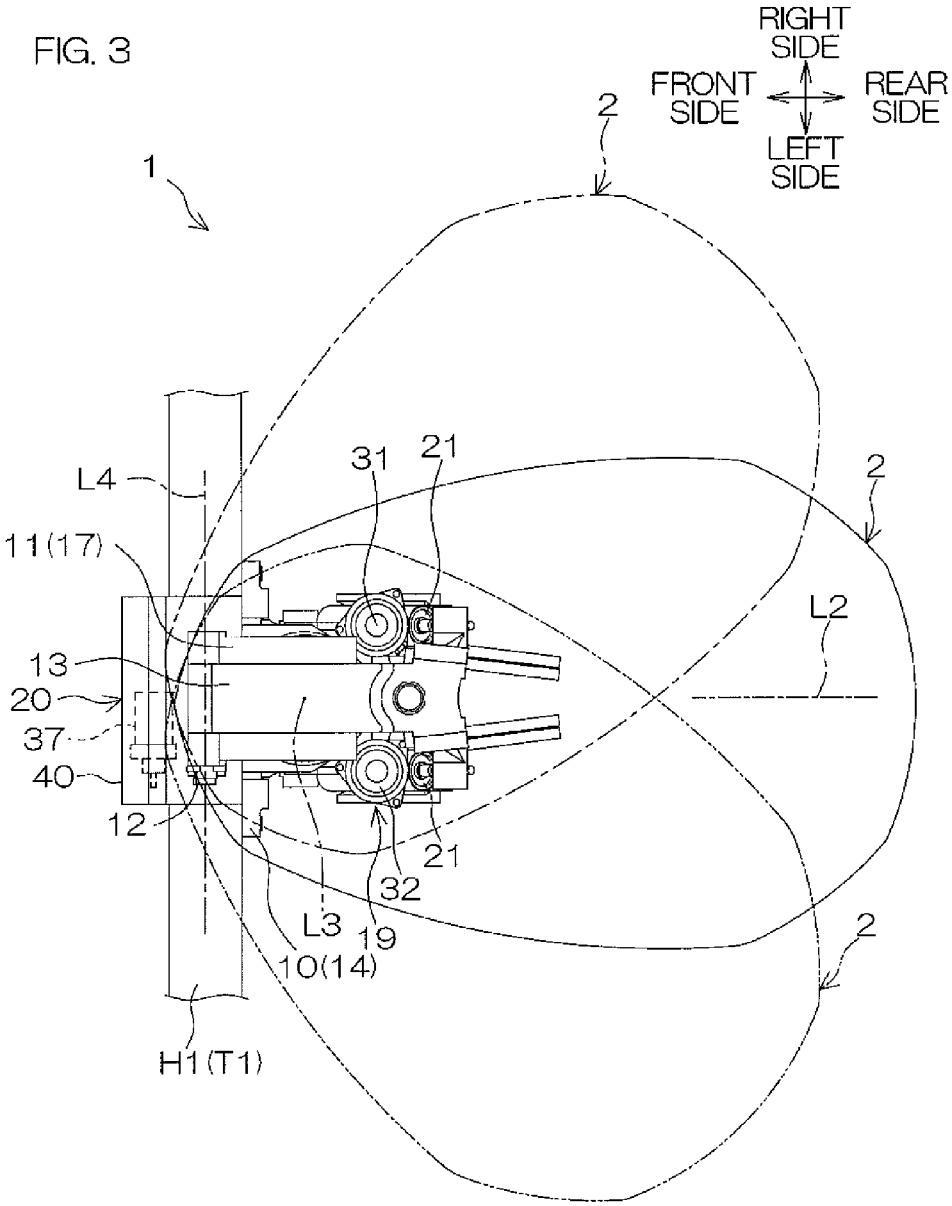
FIG. 3 is a plan view of the first marine vessel propulsion apparatus according to the first preferred embodiment of the present invention.
Figure 4A:
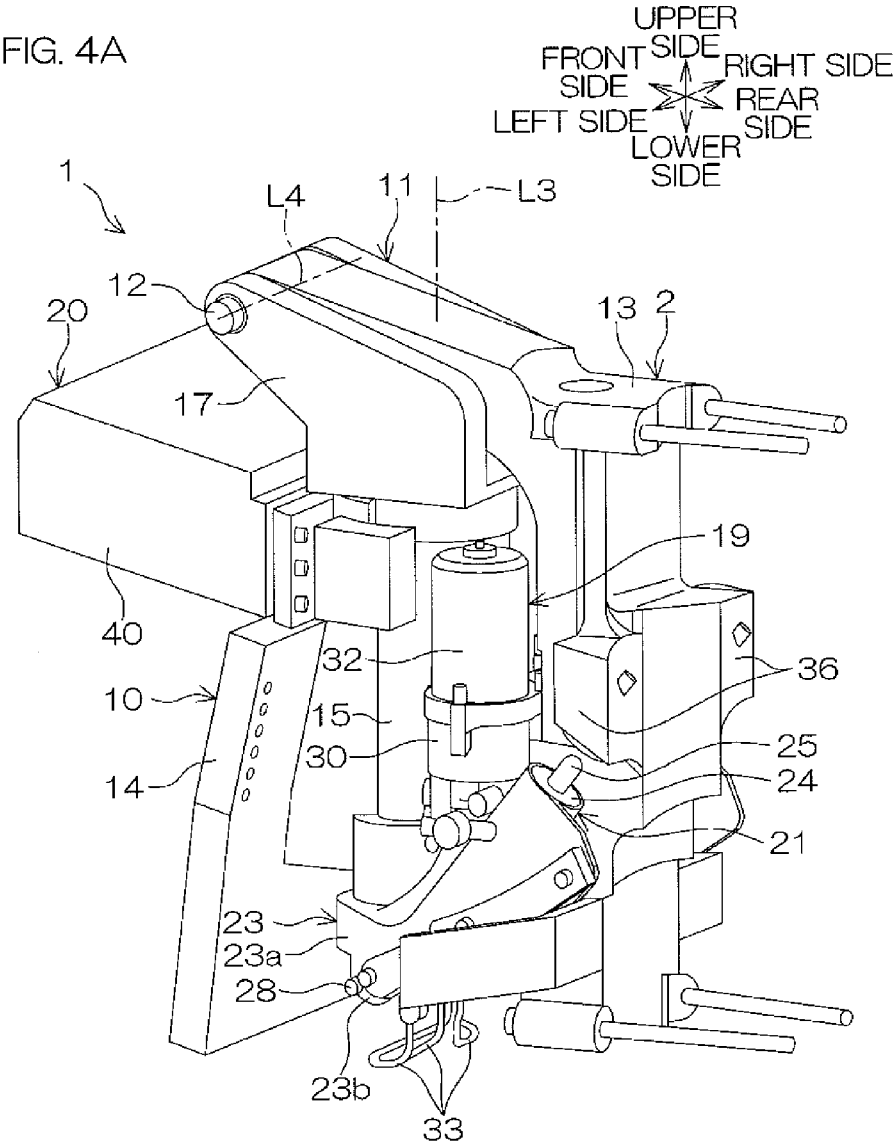
FIG. 4A is a perspective view of a portion of the first marine vessel propulsion apparatus according to the first preferred embodiment of the present invention.
Figure 4B:
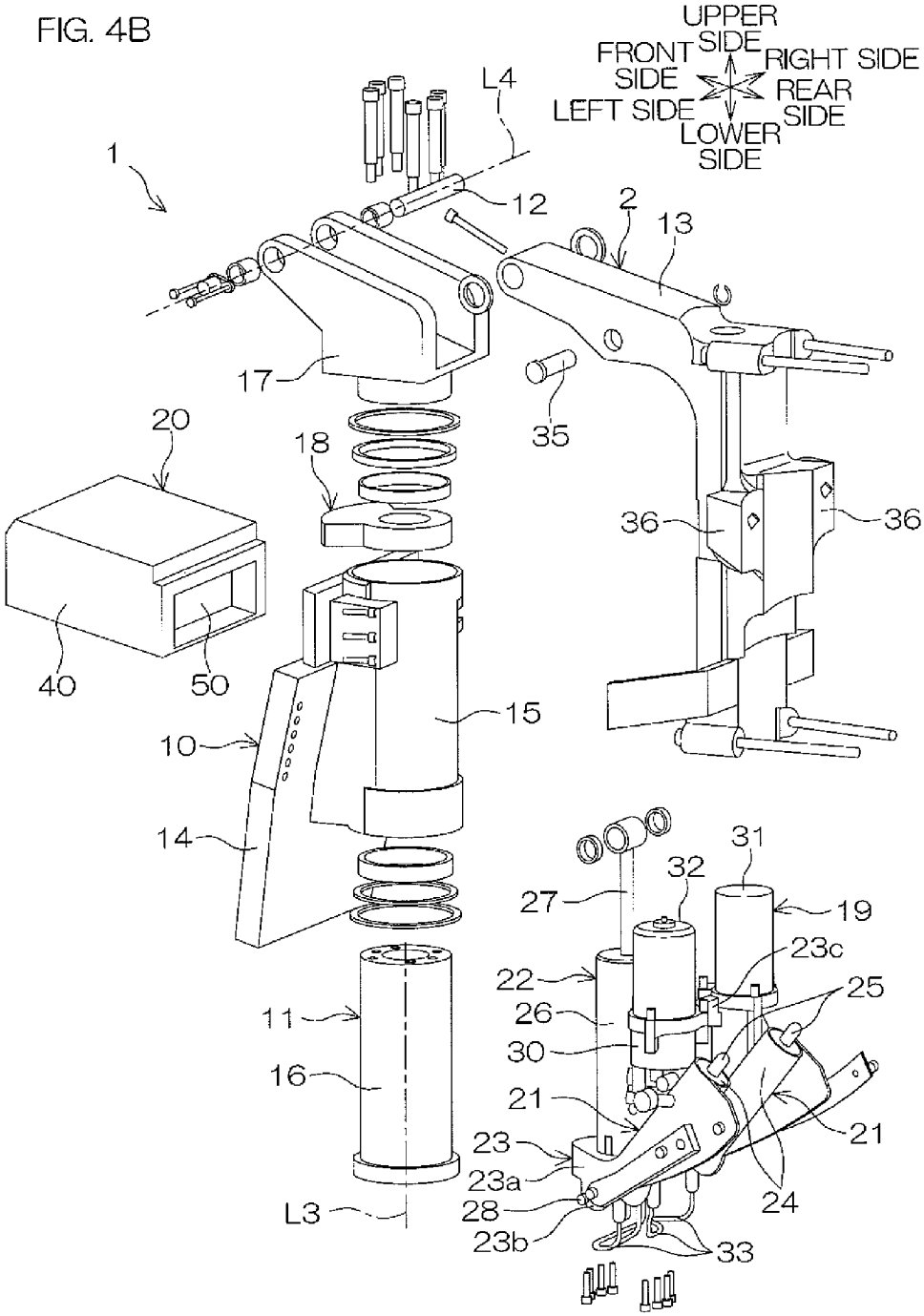
FIG. 4B is an exploded perspective view of a portion of the first marine vessel propulsion apparatus according to the first preferred embodiment of the present invention.
Figure 4C:
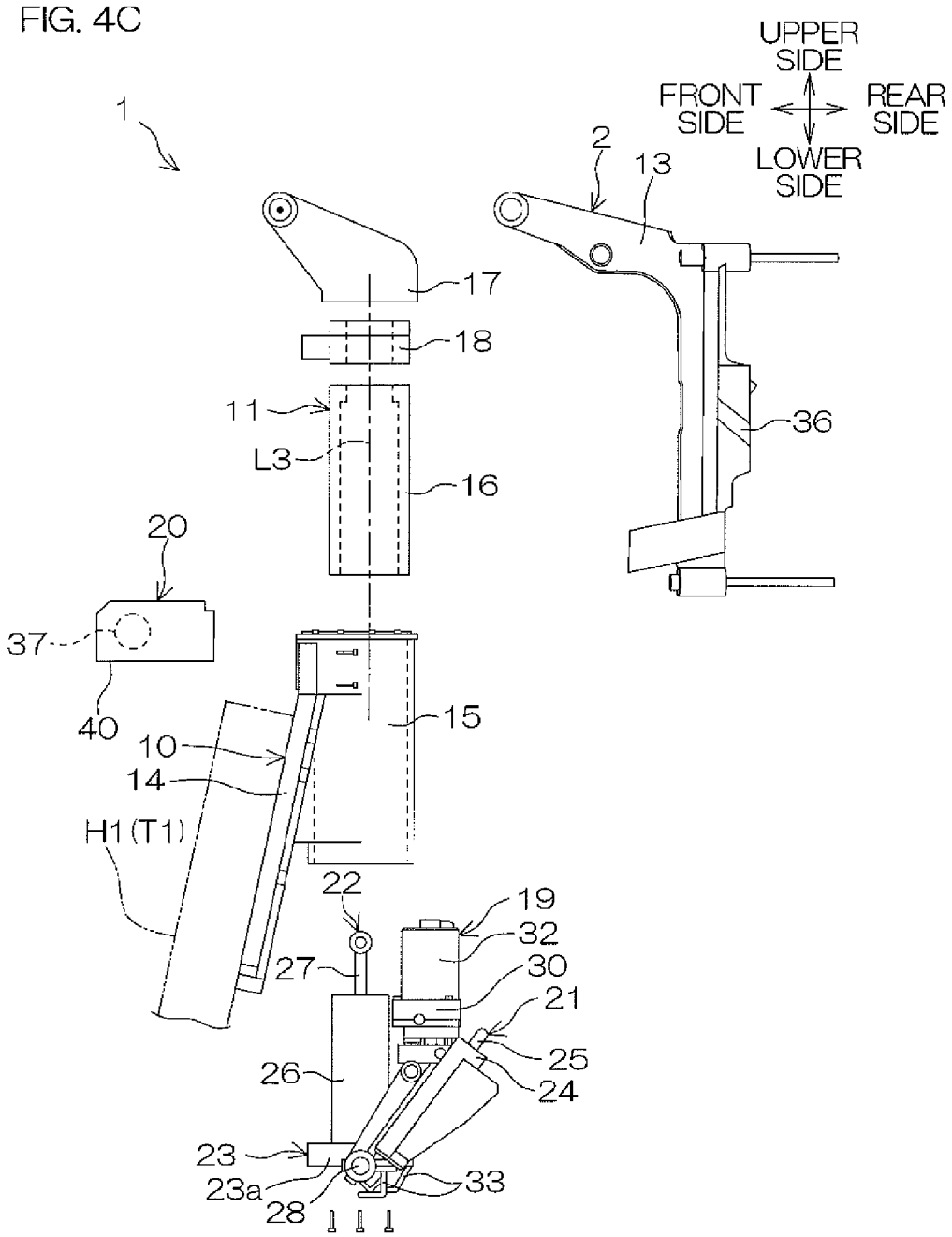
FIG. 4C is an exploded view of a portion of the first marine vessel propulsion apparatus according to the first preferred embodiment of the present invention.

FIG. 1 and FIG. 2 are side views of a first marine vessel propulsion apparatus 1 according to a first preferred embodiment of the present invention. FIG. 3 is a plan view of the first marine vessel propulsion apparatus 1 according to the first preferred embodiment of the present invention. FIG. 4A is a perspective view of a portion of the first marine vessel propulsion apparatus 1 according to the first preferred embodiment of the present invention. FIG. 4B is an exploded perspective view of a portion of the first marine vessel propulsion apparatus 1 according to the first preferred embodiment of the present invention. FIG. 4C is an exploded view of a portion of the first marine vessel propulsion apparatus 1 according to the first preferred embodiment of the present invention.

The first marine vessel propulsion apparatus 1 includes an outboard motor 2. The outboard motor 2 is attached to a transom T1 provided on the rear portion of the hull H1. The outboard motor 2 includes an engine 3, an engine cover 4, and a casing 5. The engine 3 is housed inside the engine cover 4. The engine 3 includes a crankshaft 6. The crankshaft 6 is rotatable around a crank axis L1. The crankshaft 6 is joined to a drive shaft (not shown). The drive shaft is joined to a propeller shaft (not shown). The drive shaft and the propeller shaft are housed in the casing 5. The casing 5 includes an upper case 7 and a lower case 8 disposed below the engine cover 4. The lower case 8 supports the propeller 9 rotatably around a rotational axis L2. Rotation of the crankshaft 6 is transmitted to the propeller 9 via the drive shaft and the propeller shaft. The propeller 9 is rotatable in a forward propelling direction and a backward propelling direction opposite to the forward propelling direction. The propeller 9 is driven to rotate in the forward propelling direction and the backward propelling direction by the engine 3.

The first marine vessel propulsion apparatus 1 includes a transom bracket 10, a steering shaft 11, and a tilt shaft 12. The outboard motor 2 includes a tilt bracket 13. The transom bracket 10 is attachable to the transom T1. The transom bracket 10 includes a plate-shaped attaching portion 14 to be attached to the transom T1 and a tubular housing portion 15 disposed at the rear of the attaching portion 14. The steering shaft 11 is joined to the transom bracket 10. The tilt bracket 13 is joined to the steering shaft 11 via the tilt shaft 12. The steering shaft 11 and the outboard motor 2 are turnable around a steering axis L3 extending in the up-down direction with respect to the transom bracket 10. The outboard motor 2 is turnable around a tilt axis L4 extending in the horizontal direction with respect to the transom bracket 10 and the steering shaft 11. The tilt axis L4 is a central axis of the tilt shaft 12.

As shown in FIG. 4B and FIG. 4C, the steering shaft 11 includes a tubular portion 16, a joint portion 17, and an intermediate portion 18. The steering axis L3 is the central axis of the tubular portion 16. The joint portion 17 is joined to the upper end portion of the tubular portion 16 via the intermediate portion 18. The tubular portion 16, the joint portion 17, and the intermediate portion 18 may be separate members as in this preferred embodiment, or may constitute an integral member. Specifically, the steering shaft 11 may be a member including a plurality of divided bodies, or may be an integral member. The tilt bracket 13 is joined to the joint portion 17 via the tilt shaft 12. The steering shaft 11 is inserted in the housing portion 15 of the transom bracket 10. The tubular portion 16 is housed in the housing portion 15. The housing portion 15 extends along the steering axis L3. The steering shaft 11 is turnable around the steering axis L3 with respect to the transom bracket 10.

The first marine vessel propulsion apparatus 1 includes a tilt mechanism 19. The tilt mechanism 19 is joined to the steering shaft 11 and the outboard motor 2. The tilt mechanism 19 turns the outboard motor 2 around the tilt axis L4 with respect to the transom bracket 10 and the steering shaft 11. The outboard motor 2 turns around the tilt axis L4 with respect to the steering shaft 11, so that even if the tilting angle of the outboard motor 2 changes, the steering axis L3 does not move. Specifically, the steering axis L3 is an axis that does not move with respect to the transom bracket 10. A direction in which the outboard motor 2 tilts around the tilt axis L4 so that the upper end of the crank axis L1 is positioned forward relative to the lower end of the crank axis L1 is defined as a positive direction. A range in which the tilting angle of the outboard motor 2 is small is a trim range, and a range in which the tilting angle of the outboard motor 2 is larger than the upper limit of the trim range is a tilt range.

In FIG. 2, a state in which the tilting angle of the outboard motor 2 is the lower limit (full trim-in angle) of the trim range is shown by the alternate long and short dashed lines, and a state in which the tilting angle of the outboard motor 2 is the upper limit (full trim-out angle) of the trim range is shown by the alternate long and two short dashed lines. In FIG. 2, a state in which the tilting angle of the outboard motor 2 is the upper limit (full tilt-up angle) of the tilt range is shown by the solid line. The full trim-in angle is, for example, −5 degrees, and the full trim-out angle is, for example, 15 degrees. The full tilt-up angle is, for example, 65 degrees. The tilt mechanism 19 can hold the outboard motor 2 at an arbitrary position including the trim range and the tilt range. The trim range is a range to be used mainly when adjusting the posture of the hull H1 when the marine vessel is propelled forward, and the tilt range is a range to be used mainly when the marine vessel is moored or runs in shallow water.

The first marine vessel propulsion apparatus 1 includes a steering mechanism 20. The steering mechanism 20 is joined to the transom bracket 10 and the steering shaft 11. The steering mechanism 20 turns the steering shaft 11 and the tilt shaft 12 around the steering axis L3 with respect to the transom bracket 10. The outboard motor 2 and the tilt mechanism 19 turn around the steering axis L3 together with the steering shaft 11 and the tilt shaft 12 according to turning of the steering shaft 11. The tilt shaft 12 turns around the steering axis L3 together with the outboard motor 2, so that the tilt axis L4 that is the central axis of the tilt shaft 12 turns around the steering axis L3 with respect to the transom bracket 10 according to turning of the outboard motor 2 around the steering axis L3. The position of the outboard motor 2 when the steering angle of the outboard motor 2 is zero is defined as a steering origin. As shown in FIG. 3, the outboard motor 2 is turnable to the right and left around the steering origin (the position shown by the solid line). The steering mechanism 20 turns the outboard motor 2 around the steering axis L3 between a maximum rightward steering position (the position shown by the alternate long and short dashed lines) and a maximum leftward steering position (the position shown by the alternate long and two short dashed lines). The steering mechanism 20 can hold the outboard motor 2 at an arbitrary position between the maximum rightward steering position and the maximum leftward steering position.

Figure 5:
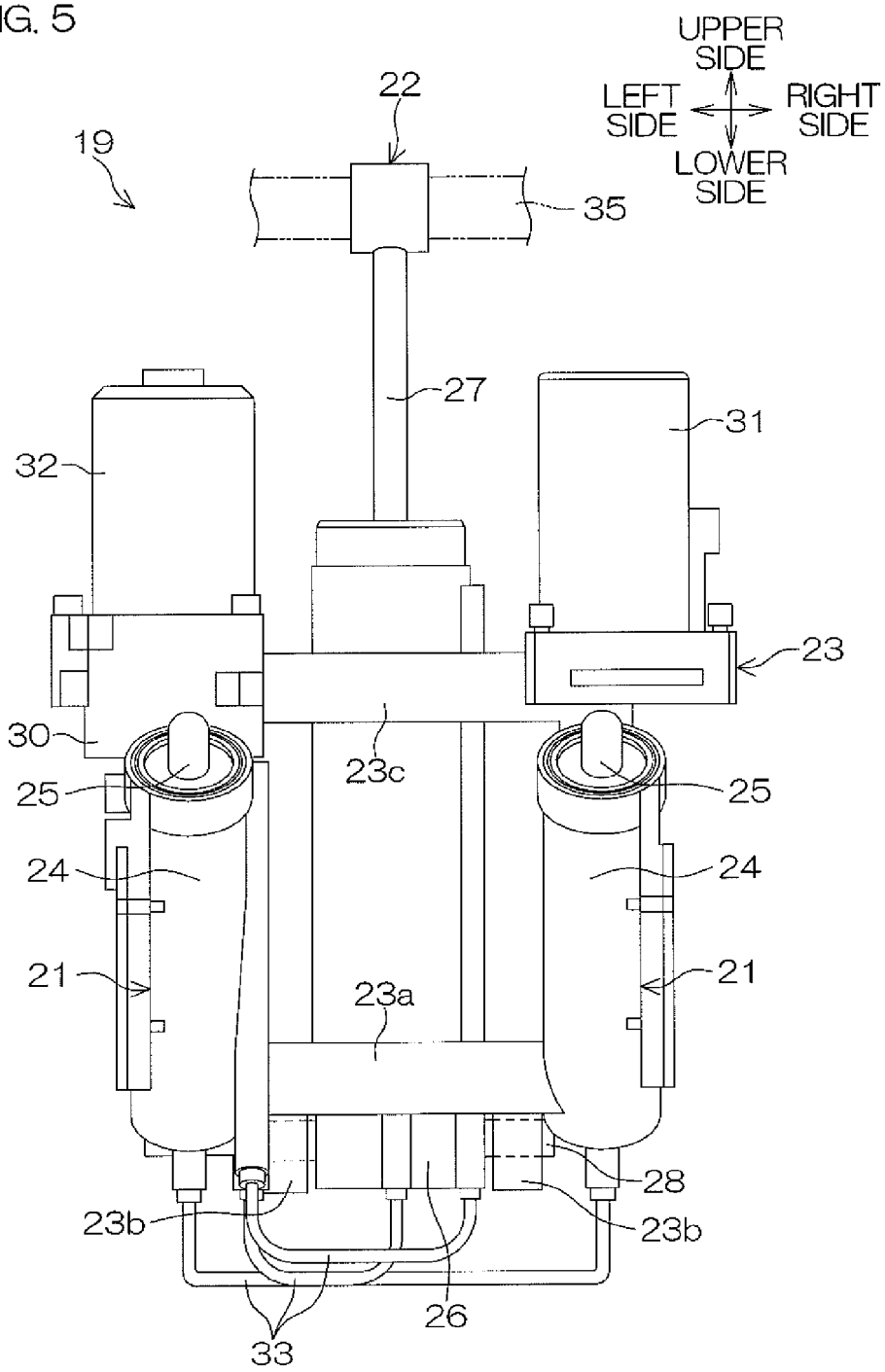
FIG. 5 is a back view of a tilt mechanism according to the first preferred embodiment of the present invention.

FIG. 5 is a back view of the tilt mechanism 19 according to the first preferred embodiment of the present invention. Hereinafter, the tilt mechanism 19 will be described with reference to FIG. 4B, FIG. 4C, and FIG. 5.

The tilt mechanism 19 includes two trim cylinders 21, a tilt cylinder 22, and a frame 23. Two trim cylinders 21 are disposed parallel or substantially parallel to each other at an interval in the right-left direction. Each trim cylinder 21 is disposed obliquely along the front-rear direction so that the upper end of the trim cylinder 21 is positioned rearward relative to the lower end of the trim cylinder 21. The tilt cylinder 22 extends in the up-down direction. The upper end of the tilt cylinder 22 (upper end portion of a tilt rod 27) is positioned higher than the trim cylinders 21. The tilt cylinder 22 is disposed so that the tilt cylinder 22 is positioned between the two trim cylinders 21 as viewed in the front-rear direction.

Each trim cylinder 21 includes a cylinder main body 24 and a trim rod 25 extending along the central axis of the trim cylinder 21. Each trim rod 25 projects upward from the upper end of the cylinder main body 24. Each cylinder main body 24 is fixed to the frame 23. On the other hand, the tilt cylinder 22 includes a cylinder main body 26 and a tilt rod 27 extending along the central axis of the tilt cylinder 22. The tilt rod 27 projects upward from the upper end of the cylinder main body 26. The lower end portion of the cylinder main body 26 is joined to the frame 23 via a lower pin 28 extending in the right-left direction. The tilt cylinder 22 is turnable around the lower pin 28 with respect to the frame 23.

The cylinders 21 and 22 preferably are, for example, hydraulic cylinders. The tilt mechanism 19 includes a pump 30 that supplies hydraulic oil, a tank 31 storing the hydraulic oil, a motor 32 that drives the pump 30, and a plurality of pipes 33 connected to the pump 30 and the tank 31. The pump 30, the tank 31, the motor 32, and the pipes 33 are held by the frame 23. The pump 30 and the tank 31 are disposed at an interval in the right-left direction. The motor 32 is disposed above the pump 30. The pump 30 and the motor 32 are disposed above one trim cylinder 21, and the tank 31 is disposed above the other trim cylinder 21. The tilt cylinder 22 is disposed so that the tilt cylinder 22 is positioned between the pump 30 and motor 32 and the tank 31 as viewed in the front-rear direction.

The frame 23 includes a seat portion 23*a* disposed along a horizontal plane, a pair of projections 23*b* projecting downward from the seat portion 23*a*, and a support portion 23*c* disposed along a horizontal plane above the seat portion 23*a*. The pair of projections 23*b* are disposed at an interval in the right-left direction below the seat portion 23*a*. The cylinder main body 24 of the trim cylinder 21 is fixed to the frame 23. In the first preferred embodiment, for example, the cylinder main body 24 of the trim cylinder 21 and the frame 23 preferably are an integral casting. The cylinder main body 26 of the tilt cylinder 22 is inserted in a through-hole 23*d* (refer to FIG. 6) penetrating through the seat portion 23*a* in the up-down direction. The lower end portion of the cylinder main body 26 of the tilt cylinder 22 is disposed between the pair of projections 23*b*. The lower end portion of the cylinder main body 26 of the tilt cylinder 22 is joined to the pair of projections 23*b* via the lower pin 28. The pump 30, the tank 31, and the electric motor 32 are supported by the support portion 23*c*.

The pump 30, the tank 31, and the motor 32 are disposed rearward relative to the tilt cylinder 22. The lateral side of the pump 30, the tank 31, and the motor 32 is opened (for example, refer to FIG. 1). Therefore, the pump 30, the tank 31, and the motor 32 are exposed. The pipes 33 project downward from the frame 23. The pipes 33 are exposed from the frame 23. The cylinder main bodies 24 and 26 are connected to the pump 30 and the tank 31 via the plurality of pipes 33. The pipes 33 lead the hydraulic oil to the cylinders 21 and 22 and the tank 31. When the pump 30 is driven by the motor 32, the hydraulic oil is supplied to the cylinders 21 and 22 from the pump 30. When the hydraulic oil is supplied to the cylinder main bodies 24 of the trim cylinders 21 from the pump 30, the projecting amounts of the trim rods 25 change. Similarly, when the hydraulic oil is supplied from the pump 30 to the cylinder main body 26 of the tilt cylinder 22, the projecting amount of the tilt rod 27 changes.

Figure 6:
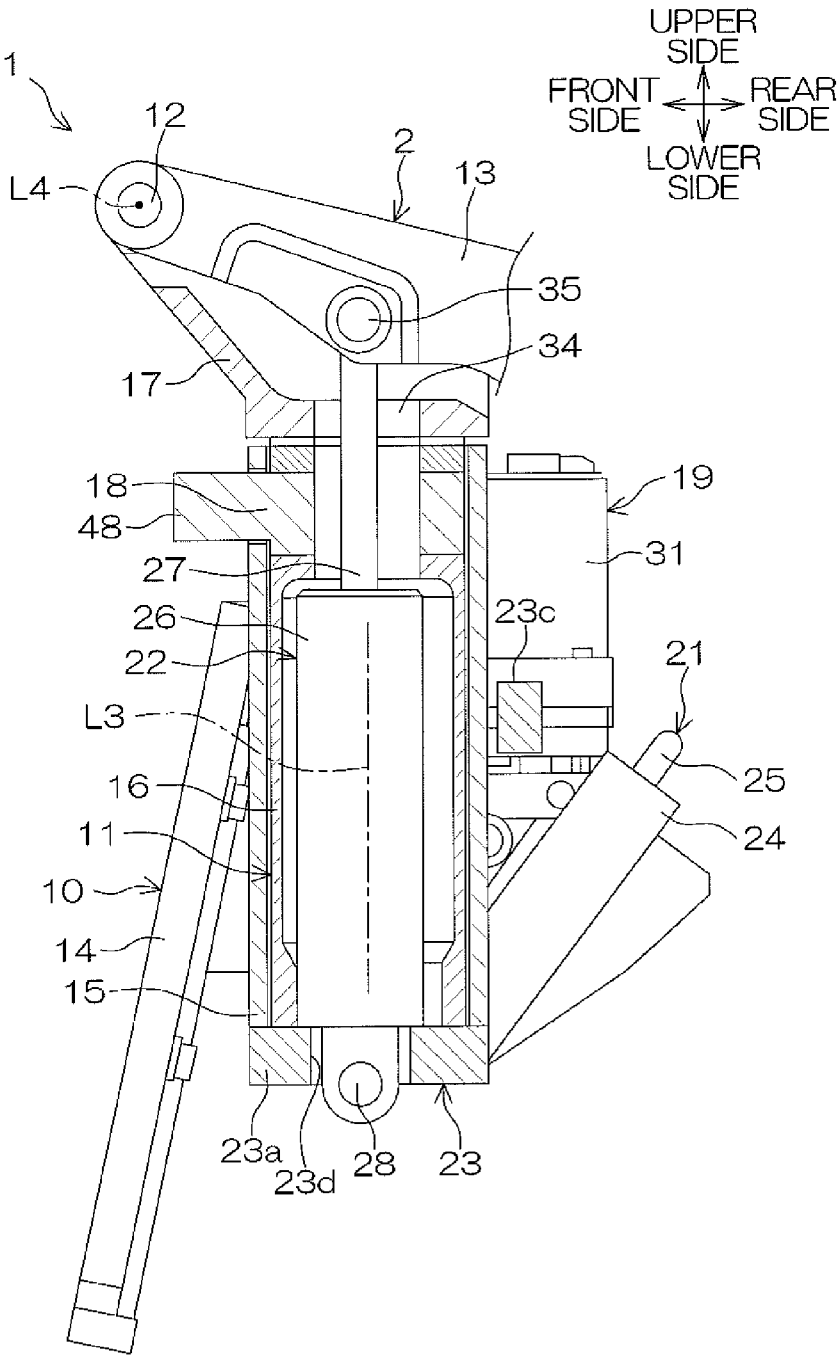
FIG. 6 is a partial sectional view of a portion of the first marine vessel propulsion apparatus including the tilt mechanism according to the first preferred embodiment of the present invention.
Figure 7:
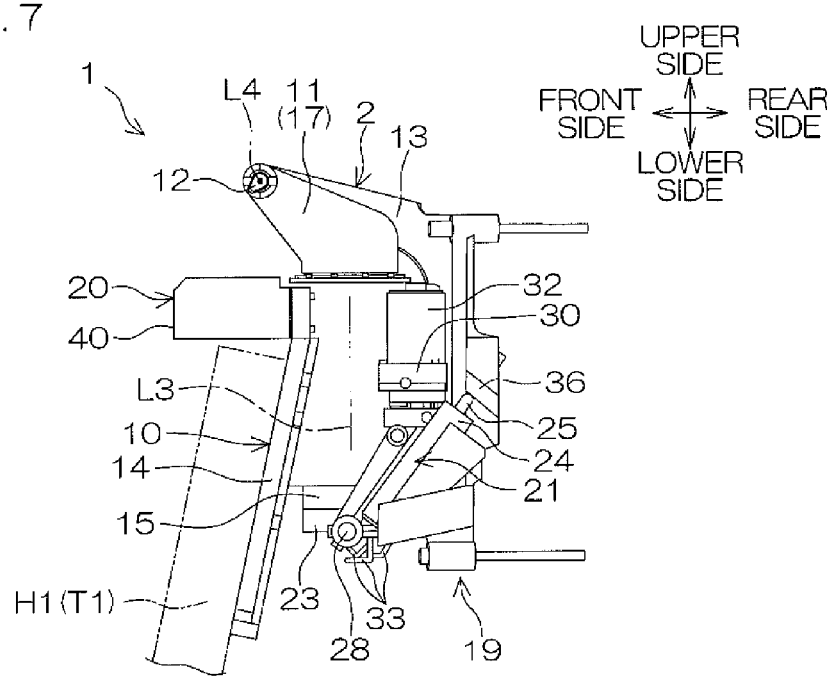
FIG. 7 is a side view of a portion of the first marine vessel propulsion apparatus including the tilt mechanism according to the first preferred embodiment of the present invention.
Figure 8:
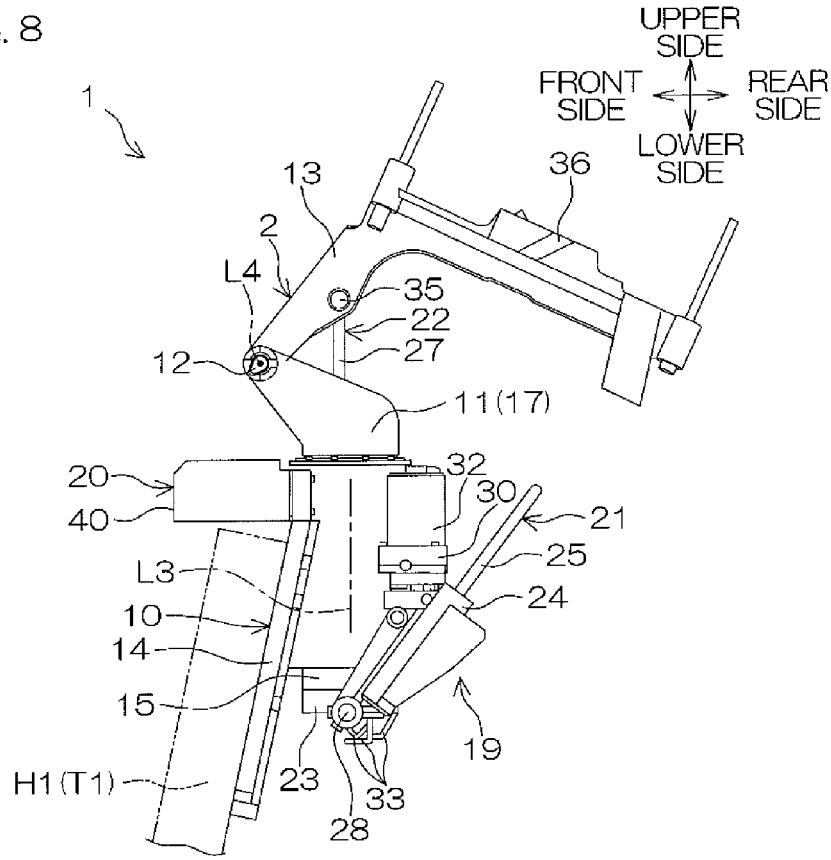
FIG. 8 is a side view of a portion of the first marine vessel propulsion apparatus including the tilt mechanism according to the first preferred embodiment of the present invention.

FIG. 6 is a partial sectional view of a portion of the first marine vessel propulsion apparatus 1 including the tilt mechanism 19 according to the first preferred embodiment of the present invention. FIG. 7 and FIG. 8 are side views of a portion of the first marine vessel propulsion apparatus 1 including the tilt mechanism 19 according to the first preferred embodiment of the present invention. FIG. 7 shows a position of the tilt bracket 13 when the outboard motor 2 is in the reference posture, and FIG. 8 shows a position of the tilt bracket 13 when the outboard motor 2 is fully tilted up.

As shown in FIG. 6, the intermediate portion 18 of the steering shaft 11 is tubular. The joint portion 17 of the steering shaft 11 has a through-hole 34 penetrating through the joint portion 17 in the up-down direction. The inside of the tubular portion 16 of the steering shaft 11 is connected to the through-hole 34 of the joint portion 17 via the inside of the intermediate portion 18. The tilt cylinder 22 is inserted in the steering shaft 11. The cylinder main body 26 is disposed inside the tubular portion 16. The lower end portion of the tubular portion 16 is joined to the frame 23. The frame 23 turns around the steering axis L3 together with the steering shaft 11. As described above, the cylinders 21 and 22, the pump 30, the tank 31, the motor 32, and the pipes 33 are held on the frame 23. Therefore, the cylinders 21 and 22, the pump 30, the tank 31, the motor 32, and the pipes 33 turn around the steering axis L3 together with the steering shaft 11.

The upper end portion of the tilt rod 27 projects upward from the through-hole 34 of the joint portion 17. The upper end portion of the tilt rod 27 is joined to the tilt bracket 13 via an upper pin 35 extending in the right-left direction. Therefore, the outboard motor 2 is supported by the tilt cylinder 22. The tilt rod 27 is turnable around the upper pin 35 with respect to the tilt bracket 13. On the other hand, as shown in FIG. 7, in a state in which the outboard motor 2 is positioned in the trim range, the tip ends of the trim rods 25 are in contact with contact portions 36 provided on the tilt bracket 13. Therefore, in the state in which the outboard motor 2 is positioned in the trim range, the outboard motor 2 is supported by the tilt cylinder 22 and the two trim cylinders 21. The contact portions 36 project laterally.

When the projecting amount of the tilt rod 27 increases, the tilt bracket 13 is pushed up by the tilt rod 27 and the outboard motor 2 turns up around the tilt axis L4. When the projecting amounts of the trim rods 25 increase in the state in which the outboard motor 2 is positioned in the trim range, the tilt bracket 13 is pushed up by the trim rods 25 and the outboard motor 2 turns up around the tilt axis L4. The tilt cylinder 22 can hold the outboard motor 2 at an arbitrary position between a full trim-in angle (see the outboard motor 2 shown by the alternate long and short dashed lines in FIG. 2) and a full tilt-up angle (see the outboard motor 2 shown by the solid line in FIG. 2). On the other hand, the trim cylinders 21 can hold the outboard motor 2 at an arbitrary position between the full trim-in angle and a full trim-out angle (see the outboard motor 2 shown by the alternate long and two short dashed lines in FIG. 2). Specifically, as shown in FIG. 8, when the tilting angle of the outboard motor 2 becomes larger than the full trim-out angle, the tip ends of the trim rods 25 separate from the contact portions 36 of the tilt bracket 13. Therefore, in the tilt range, the outboard motor 2 is supported by the tilt cylinder 22.

Figure 9:
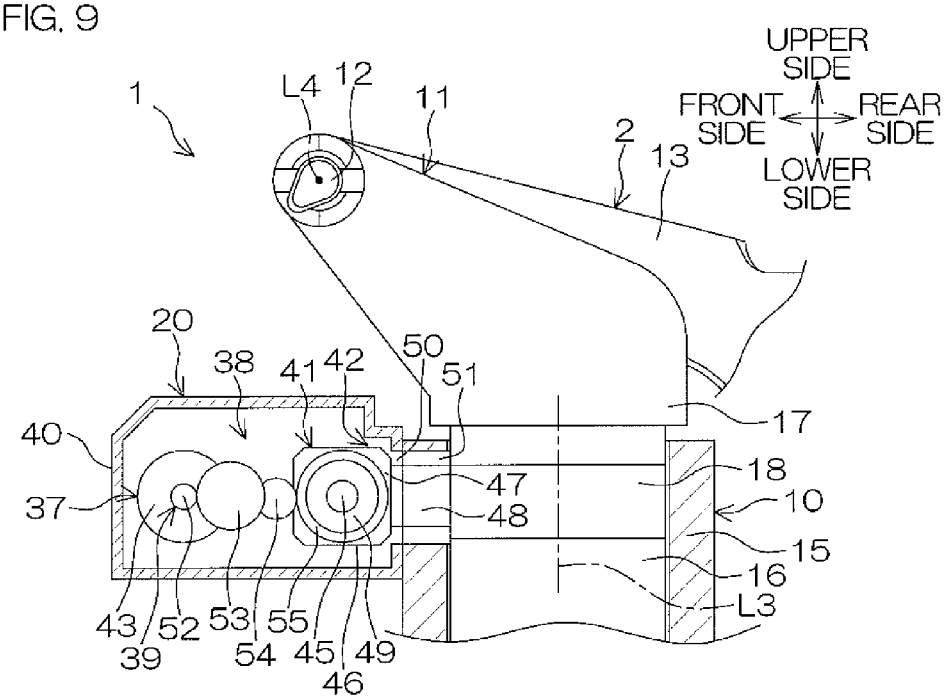
FIG. 9 is a partial sectional view of a portion of the first marine vessel propulsion apparatus including a steering mechanism according to the first preferred embodiment of the present invention.
Figure 10:
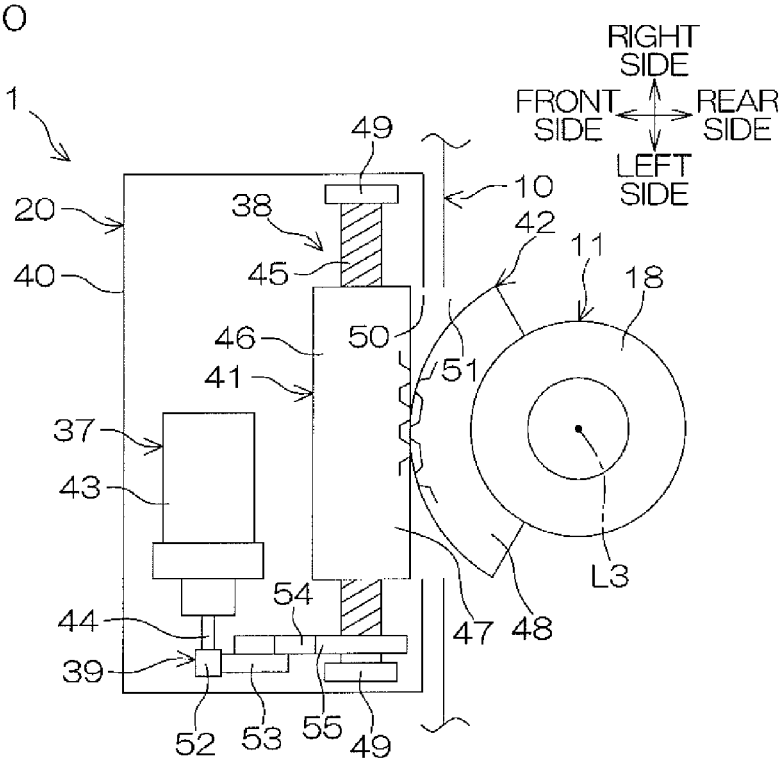
FIG. 10 is a schematic plan view of a portion of the first marine vessel propulsion apparatus including the steering mechanism according to the first preferred embodiment of the present invention.
Figure 11:
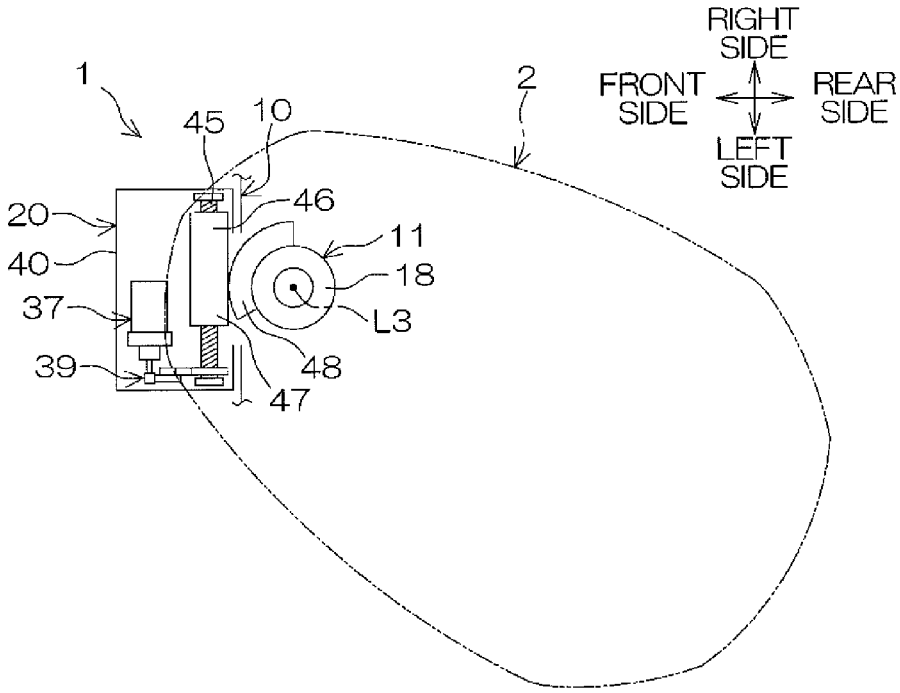
FIG. 11 is a schematic plan view of a portion of the first marine vessel propulsion apparatus including the steering mechanism according to the first preferred embodiment of the present invention.

FIG. 9 is a partial sectional view of a portion of the first marine vessel propulsion apparatus 1 including a steering mechanism 20 according to the first preferred embodiment of the present invention. FIG. 10 and FIG. 11 are schematic plan views of a portion of the first marine vessel propulsion apparatus 1 including the steering mechanism 20 according to the first preferred embodiment of the present invention.

The steering mechanism 20 includes an electric motor 37, a power conversion mechanism 38, a reduction gear mechanism 39, and a steering case 40. The reduction gear mechanism 39 decelerates the rotation of the electric motor 37 and transmits the decelerated rotation to the power conversion mechanism 38. The power conversion mechanism 38 converts the power of the electric motor 37 transmitted by the reduction gear mechanism 39 into turning of the steering shaft 11 around the steering axis L3. The outboard motor 2 turns around the steering axis L3 with respect to the transom bracket 10 according to turning of the steering shaft 11 around the steering axis L3. The power conversion mechanism 38 includes a first conversion mechanism 41 that converts the rotation of the electric motor 37 into linear motion, and a second conversion mechanism 42 that converts the linear motion into turning of the steering shaft 11 around the steering axis L3 with respect to the transom bracket 10.

The electric motor 37 includes a motor main body 43 and a rotary shaft 44. The rotary shaft 44 is rotatable in the forward direction and the reverse direction opposite to the forward direction. The rotation of the rotary shaft 44 is transmitted to the first conversion mechanism 41 of the power conversion mechanism 38 via the reduction gear mechanism 39. The electric motor 37 is housed in a steering case 40. The electric motor 37 is disposed so that, for example, the rotary shaft 44 extends in the right-left direction. The motor main body 43 is fixed to the steering case 40. The steering case 40 is fixed to the transom bracket 10. Therefore, the electric motor 37 is fixed to the transom bracket 10 via the steering case 40. The electric motor 37 may be fixed to the transom bracket 10 via an intermediate member such as the steering case 40, or may be directly fixed to the transom bracket 10.

The first conversion mechanism 41 includes a first ball screw 45, and a tubular first ball nut 46 attached to the first ball screw 45 via a plurality of balls. The second conversion mechanism 42 includes a first rack 47 joined to the first ball nut 46, and a first pinion 48 engaged with the first rack 47. The first ball screw 45, the first ball nut 46, and the first rack 47 are housed in the steering case 40, and are held by the steering case 40. On the other hand, most of the first pinion 48 is disposed outside the steering case 40. The first pinion 48 is joined to the intermediate portion 18. Therefore, the first pinion 48 is joined to the tubular portion 16 and the joint portion 17 via the intermediate portion 18. The first pinion 48 turns around the steering axis L3 together with the steering shaft 11.

The first ball screw 45 extends in the right-left direction inside the steering case 40. The rotational axis of the first ball screw 45 and the rotational axis of the electric motor 37 are parallel or substantially parallel to each other. The first ball screw 45 is disposed rearward relative to the electric motor 37. Both end portions of the first ball screw 45 are supported on the steering case 40 via bearings 49. The first ball screw 45 is joined to the transom bracket 10 via the steering case 40, and joined to the electric motor 37 via the reduction gear mechanism 39. The rotation of the electric motor 37 is transmitted to the first ball screw 45 via the reduction gear mechanism 39. Accordingly, the first ball screw 45 is driven so as to be rotated by the electric motor 37. When the first ball screw 45 rotates around the central axis of the first ball screw 45, the first ball nut 46 moves along the first ball screw 45, and the rotation of the first ball screw 45 is converted into linear motion of the first ball nut 46 with respect to the first ball screw 45.

The first rack 47 is provided on the outer peripheral portion of the first ball nut 46. The first rack 47 is, for example, integral with the first ball nut 46. The first rack 47 and the first ball nut 46 may constitute an integral member, or may constitute a member including a plurality of divided bodies joined integrally. The first rack 47 includes a plurality of teeth aligned in the axial direction of the first ball screw 45. The first rack 47 is opposed to the steering opening 50 provided in the steering case 40. The inside of the steering case 40 is connected to the inside of the housing portion 15 via a transom opening 51 provided in the housing portion 15 of the transom bracket 10. When the first ball screw 45 rotates, the first rack 47 moves along the first ball screw 45 together with the first ball nut 46.

The first pinion 48 projects from the outer peripheral portion of the intermediate portion 18. The first pinion 48 has, for example, a fan shape having a central axis positioned on the steering axis L3. The first pinion 48 is, for example, integral with the intermediate portion 18. The first pinion 48 and the intermediate portion 18 may constitute an integral member, or may constitute a member including a plurality of divided bodies joined integrally. The first pinion 48 enters the inside of the steering case 40 through the steering opening 50 and the transom opening 51. When the first rack 47 moves in the axial direction of the first ball crew 45, the position of engagement between the first rack 47 and the first pinion 48 moves and the first pinion 48 turns around the steering axis L3. Accordingly, the linear motion of the first ball nut 46 is converted into turning of the steering shaft 11 around the steering axis L3.

The reduction gear mechanism 39 includes a plurality of reduction gears (a first reduction gear 52, a second reduction gear 53, a third reduction gear 54, and a fourth reduction gear 55). The reduction gears 52 to 55 are, for example, external gears. The first reduction gear 52 is joined to the rotary shaft 44 of the electric motor 37. The first reduction gear 52 and the rotary shaft 44 are disposed coaxially with each other. The first reduction gear 52 rotates together with the rotary shaft 44. The first reduction gear 52 engages with the second reduction gear 53, and the second reduction gear 53 engages with the third reduction gear 54. The third reduction gear 54 engages with the fourth reduction gear 55. The second reduction gear 53 and the third reduction gear 54 are held rotatably by the steering case 40. The fourth reduction gear 55 is joined to the first ball screw 45. The fourth reduction gear 55 and the first ball screw 45 are disposed coaxially with each other. The first ball screw 45 rotates together with the fourth reduction gear 55.

The rotation of the electric motor 37 is transmitted to the first ball screw 45 by the reduction gear mechanism 39. The power of the electric motor 37 is amplified by deceleration of the rotation of the electric motor 37 by the reduction gear mechanism 39. The rotation of the first ball screw 45 is converted into linear motion of the first ball nut 46 with respect to the first ball screw 45 by the first ball screw 45 and the first ball nut 46. Then, the linear motion of the first ball nut 46 is converted into turning of the steering shaft 11 around the steering axis L3 by the first rack 47 and the first pinion 48. Accordingly, as shown in FIG. 11, the outboard motor 2 turns around the steering axis L3 with respect to the transom bracket 10. When the rotary shaft 44 of the electric motor 37 is driven to rotate in the forward direction, the outboard motor 2 turns in one rotating direction around the steering axis L3, and when the rotary shaft 44 of the electric motor 37 is driven to rotate in the reverse direction, the outboard motor 2 turns in the other rotating direction around the steering axis L3.

As described above, the electric motor 37 is fixed to the transom bracket 10 via the steering case 40. Therefore, when the outboard motor 2 turns around the steering axis L3 with respect to the transom bracket 10, the electric motor 37 does not turn around the steering axis L3 with respect to the transom bracket 10 together with the outboard motor 2 (refer to FIG. 11). Specifically, when the outboard motor 2 turns around the steering axis L3 with respect to the transom bracket 10, the position of the electric motor 37 with respect to the outboard motor 2 changes. On the other hand, the electric motor 37 is fixed to the transom bracket 10, so that when the outboard motor 2 turns around the tilt axis L4 with respect to the transom bracket 10, the electric motor 37 does not turn around the tilt axis L4 with respect to the transom bracket 10 together with the outboard motor 2 (refer to FIG. 2). Specifically, when the outboard motor 2 turns around the tilt axis L4 with respect to the transom bracket 10, the position of the electric motor 37 with respect to the outboard motor 2 changes.

As described above, in the first preferred embodiment, the steering mechanism 20 includes the electric motor 37 and the power conversion mechanism 38. Specifically, the steering mechanism 20 is an electric steering mechanism that includes an electric motor. The electric motor 37 is driven by supply of electric power. The power of the electric motor 37 is converted into turning of the steering shaft 11 around the steering axis L3. The outboard motor 2 and the steering shaft 11 are turnable around the steering axis L3 with respect to the transom bracket 10. Therefore, by converting the power of the electric motor 37 into turning of the steering shaft 11 around the steering axis L3, the outboard motor 2 turns around the steering axis L3 with respect to the transom bracket 10. Accordingly, the marine vessel is steered.

In the electric steering mechanism, a time lag between a steering command to turn the outboard motor 2 around the steering axis L3 and turning of the outboard motor 2 is smaller than that of a hydraulic steering mechanism. Therefore, the electric motor 37 does not need to be driven when the outboard motor 2 is not turned around the steering axis L3, and energy loss can be reduced as compared with a marine vessel propulsion apparatus that includes a hydraulic steering mechanism. In addition, the steering mechanism 20 can control the stop position of the outboard motor 2 and the turning angle of the outboard motor 2 with high accuracy as compared with a hydraulic steering mechanism. Further, the steering mechanism 20 does not need a hydraulic pump and a tank, etc., so that the steering mechanism can be decreased in size as compared with a marine vessel propulsion apparatus including a hydraulic steering mechanism.

Second Preferred Embodiment

Figure 12:
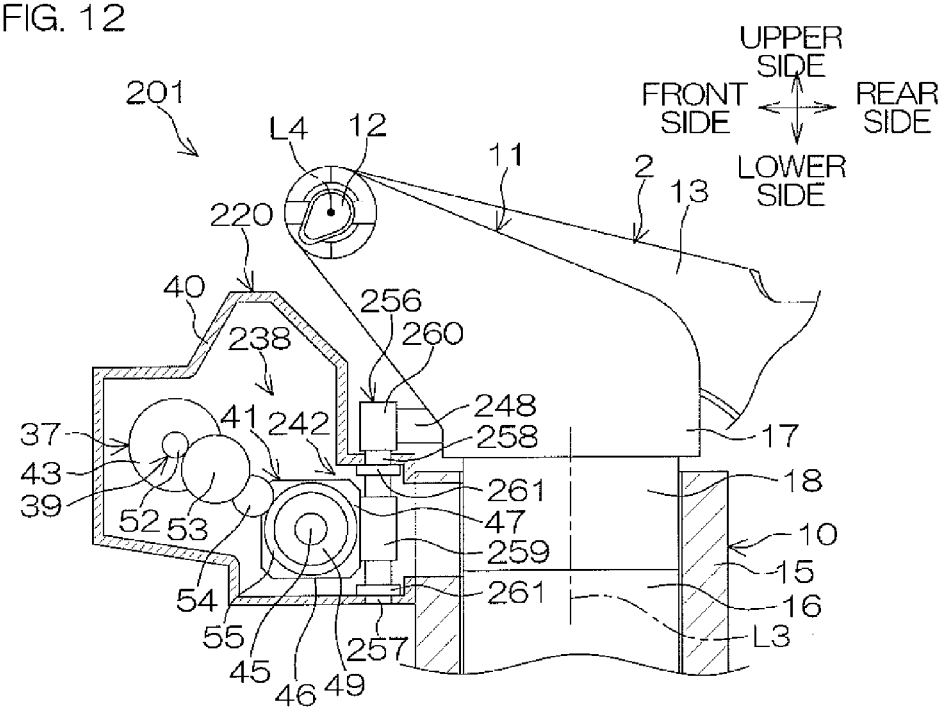
FIG. 12 is a partial sectional view of a portion of a first marine vessel propulsion apparatus including a steering mechanism according to a second preferred embodiment of the present invention.
Figure 13:
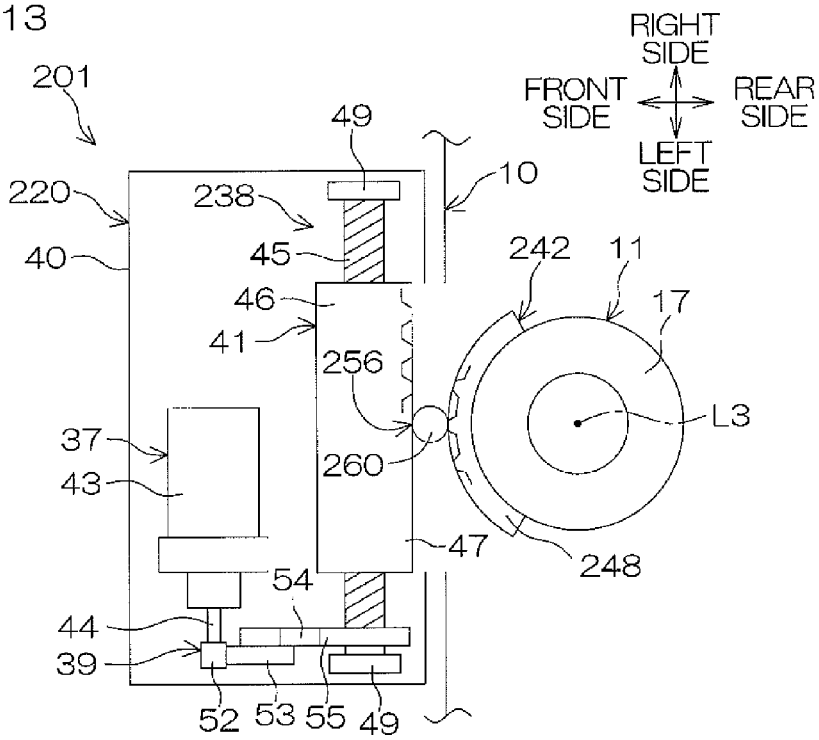
FIG. 13 is a schematic plan view of a portion of the first marine vessel propulsion apparatus including the steering mechanism according to the second preferred embodiment of the present invention.
Figure 14:
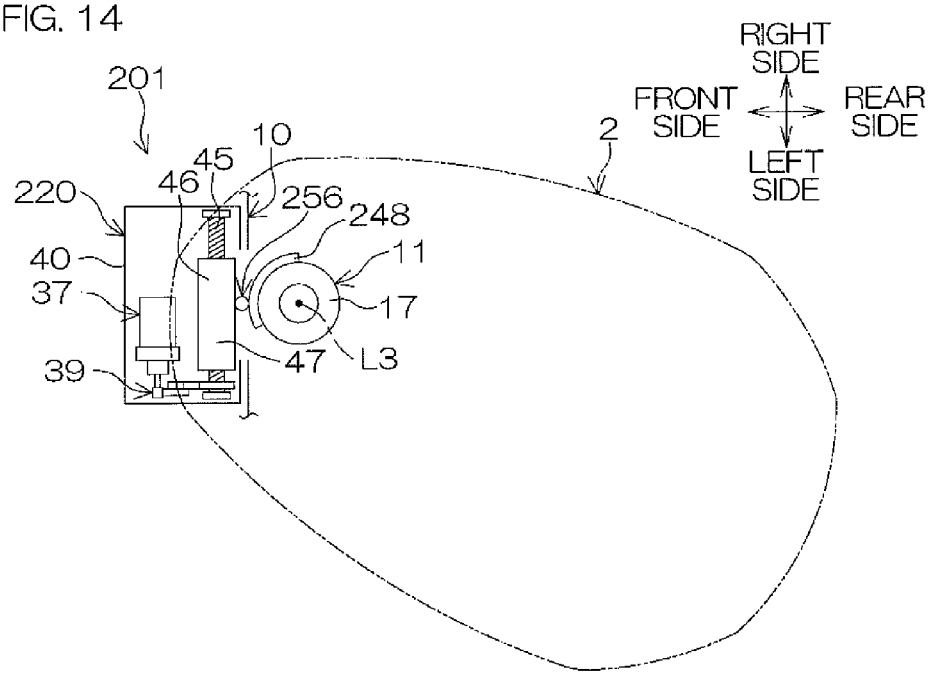
FIG. 14 is a schematic plan view of a portion of the first marine vessel propulsion apparatus including the steering mechanism according to the second preferred embodiment of the present invention.

FIG. 12 is a partial sectional view of a portion of a first marine vessel propulsion apparatus 201 including a steering mechanism 220 according to a second preferred embodiment of the present invention. FIG. 13 and FIG. 14 are schematic plan views of a portion of the first marine vessel propulsion apparatus 201 including the steering mechanism 220 according to the second preferred embodiment of the present invention. In FIG. 12 to FIG. 14, components equivalent to those shown in FIG. 1 to FIG. 11 described above are provided with the same reference numerals as in FIG. 1, etc., and description thereof will be omitted.

A major difference between the second preferred embodiment and the above-described first preferred embodiment is that the steering mechanism 220 is provided instead of the steering mechanism 20. The steering mechanism 220 includes the electric motor 37, a power conversion mechanism 238, the reduction gear mechanism 39 and the steering case 40. The power conversion mechanism 238 includes the first conversion mechanism 41 and a second conversion mechanism 242. The linear motion of the first rack 47 is converted into turning of the steering shaft 11 around the steering axis L3 by an intermediate gear 256.

In detail, the second conversion mechanism 242 includes an intermediate gear 256 that transmits power from the first rack 47 to the second pinion 248. The intermediate gear 256 has a columnar shape. The intermediate gear 256 extends in the up-down direction. The intermediate gear 256 includes a first supported portion 257, a second supported portion 258, a first gear portion 259, and a second gear portion 260 aligned along the central axis of the intermediate gear 256. The first supported portion 257, the second supported portion 258, the first gear portion 259, and the second gear portion 260 are disposed coaxially. The first gear portion 259 is disposed between the first supported portion 257 and the second supported portion 258, and the second supported portion 258 is disposed between the first gear portion 259 and the second gear portion 260. The first supported portion 257 and the second supported portion 258 are supported rotatably by the steering case 40. The gap between the first supported portion 257 and the steering case 40 is sealed by a seal member 261, and the gap between the second supported portion 258 and the steering case 40 is sealed by a seal member 261.

The first gear portion 259 is disposed inside the steering case 40. The first gear portion 259 engages with the first rack 47. On the other hand, the second gear portion 260 is disposed outside the steering case 40. The second gear portion 260 engages with the second pinion 248. The second pinion 248 has, for example, a fan shape having a central axis positioned on the steering axis L3. The second pinion 248 is joined to the joint portion 17. The second pinion 248 turns around the steering axis L3 together with the joint portion 17. The linear motion of the first rack 47 is converted into rotation of the intermediate gear 256 by the first rack 47 and the first gear portion 259. Then, the rotation of the intermediate gear 256 is converted into turning of the joint portion 17 around the steering axis L3 by the second pinion 248 and the second gear portion 260. Accordingly, the outboard motor 2 turns around the steering axis L3 with respect to the transom bracket 10.

Third Preferred Embodiment

Figure 15:
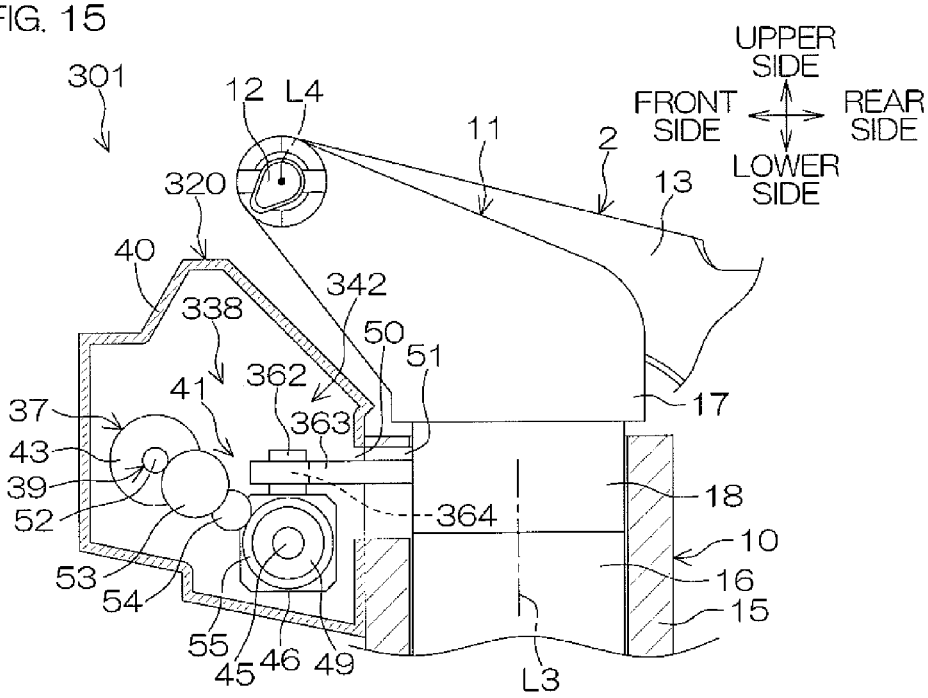
FIG. 15 is a partial sectional view of a portion of a first marine vessel propulsion apparatus including a steering mechanism according to a third preferred embodiment of the present invention.
Figure 16:
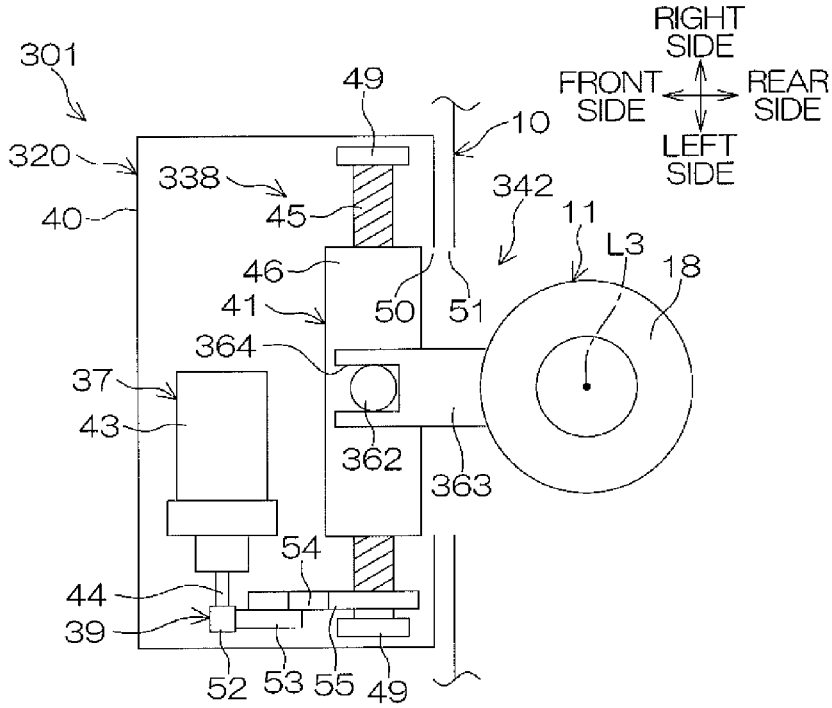
FIG. 16 is a schematic plan view of a portion of the first marine vessel propulsion apparatus including the steering mechanism according to the third preferred embodiment of the present invention.
Figure 17:
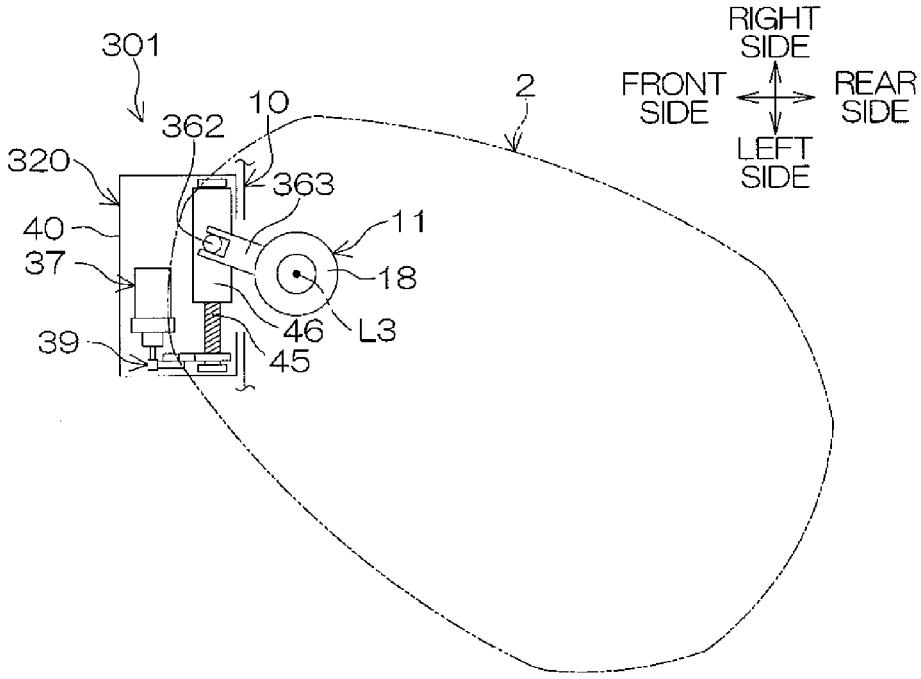
FIG. 17 is a schematic plan view of a portion of the first marine vessel propulsion apparatus including the steering mechanism according to the third preferred embodiment of the present invention.

FIG. 15 is a partial sectional view of a portion of a first marine vessel propulsion apparatus 301 including a steering mechanism 320 according to a third preferred embodiment of the present invention. FIG. 16 and FIG. 17 are schematic plan views of a portion of the first marine vessel propulsion apparatus 301 including the steering mechanism 320 according to the third preferred embodiment of the present invention. In FIG. 15 to FIG. 17, components equivalent to those shown in FIG. 1 to FIG. 14 described above are provided with the same reference numerals as in FIG. 1, etc., and description thereof will be omitted.

A major difference between this third preferred embodiment and the above-described first preferred embodiment is that the steering mechanism 320 is provided instead of the steering mechanism 20. The steering mechanism 320 includes the electric motor 37, a power conversion mechanism 338, the reduction gear mechanism 39, and the steering case 40. The power conversion mechanism 338 includes the first conversion mechanism 41 and a second conversion mechanism 342. The linear motion of the first ball nut 46 is converted into turning of the steering shaft 11 around the steering axis L3 by a first pin 362 and a first arm 363.

In detail, the second conversion mechanism 342 includes the first pin 362 joined to the first ball nut 46, and the first arm 363 joined to the first pin 362 and the steering shaft 11. For example, the first pin 362 projects upward from the first ball nut 46. The first pin 362 is housed in the steering case 40. When the first ball screw 45 rotates, the first pin 362 moves along the first ball screw 45 together with the first ball nut 46. The first arm 363 projects from the outer peripheral portion of the intermediate portion 18. The first arm 363 is, for example, integral with the intermediate portion 18. The first arm 363 and the intermediate portion 18 may constitute an integral member, or may constitute a member including a plurality of divided bodies joined integrally. The first arm 363 enters the inside of the steering case 40 through the steering opening 50 and the transom opening 51. The first arm 363 includes a forked engagement portion 364. The first pin 362 is disposed inside the engagement portion 364.

The rotation of the electric motor 37 is transmitted to the first ball screw 45 by the reduction gear mechanism 39. The rotation of the first ball screw 45 is converted into linear motion of the first ball nut 46 with respect to the first ball screw 45 by the first ball screw 45 and the first ball nut 46. The first pin 362 moves along the first ball screw 45 together with the first ball nut 46. When the first pin 362 moves along the first ball screw 45, the first pin 362 and the first arm 363 turn relative to each other around the central axis of the first pin 362, and the intermediate portion 18 of the steering shaft 11 turns around the steering axis L3. Therefore, the linear motion of the first ball nut 46 is converted into turning of the steering shaft 11 by the first pin 362 and the first arm 363. Accordingly, the outboard motor 2 turns around the steering axis L3 with respect to the transom bracket 10.

Fourth Preferred Embodiment

Figure 18:
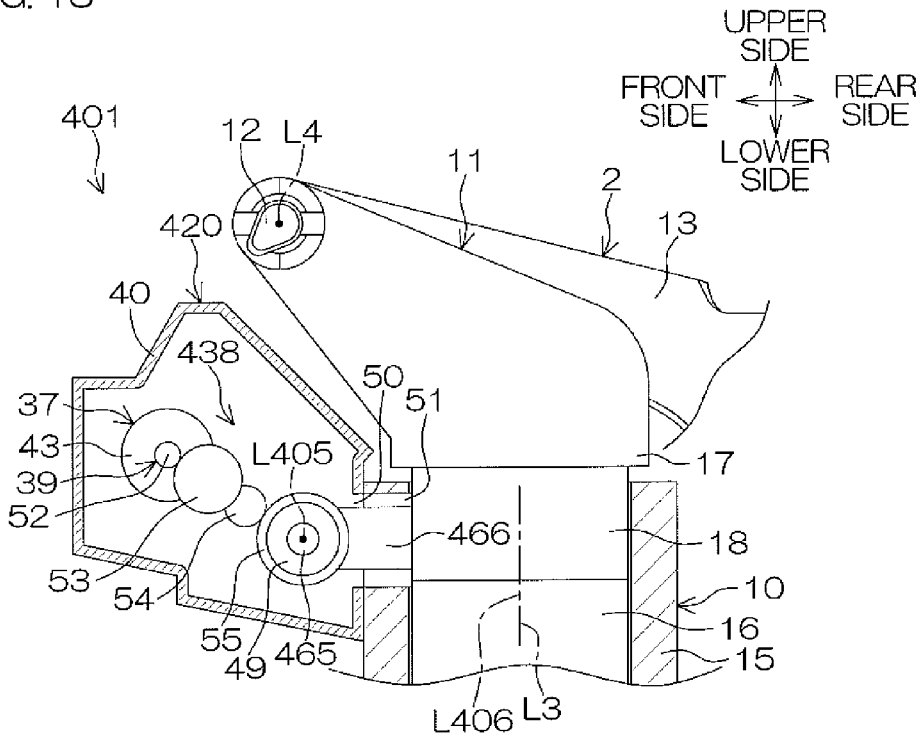
FIG. 18 is a partial sectional view of a portion of a first marine vessel propulsion apparatus including a steering mechanism according to a fourth preferred embodiment of the present invention.
Figure 19:
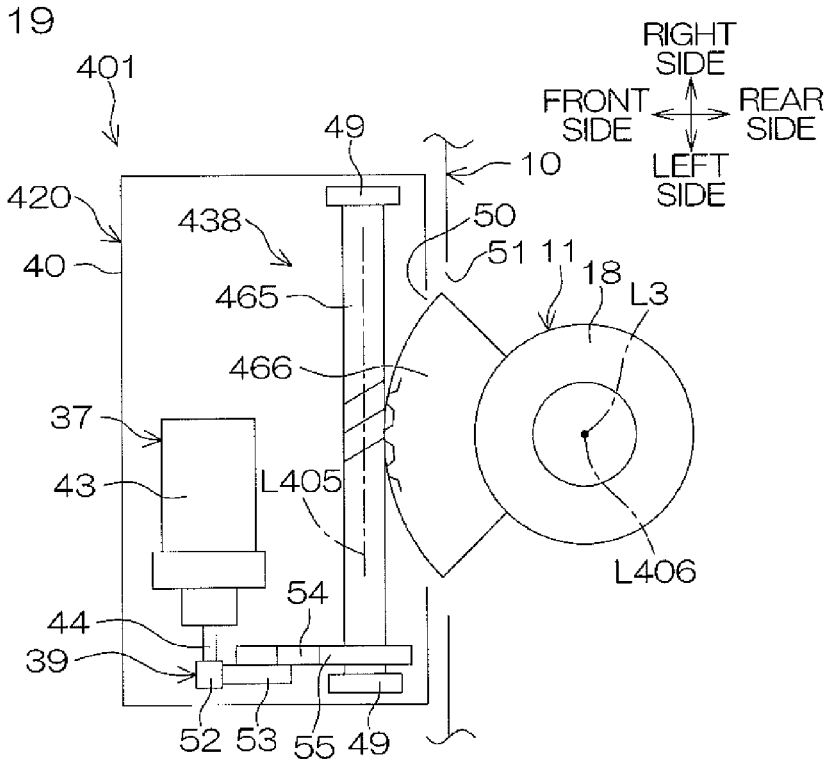
FIG. 19 is a schematic plan view of a portion of the first marine vessel propulsion apparatus including the steering mechanism according to the fourth preferred embodiment of the present invention.
Figure 20:
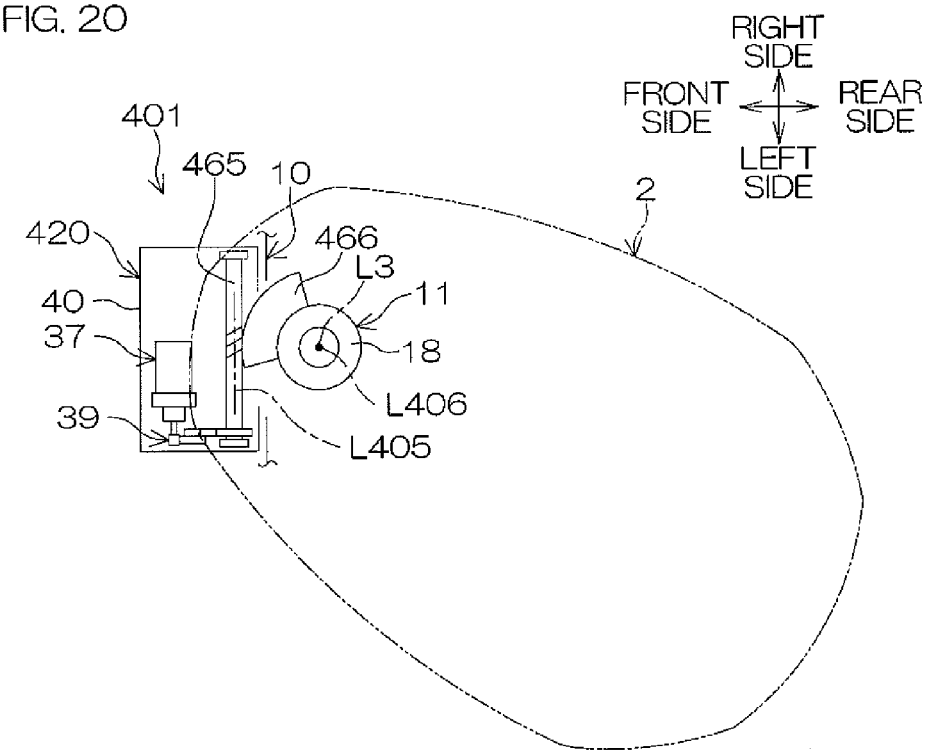
FIG. 20 is a schematic plan view of a portion of the first marine vessel propulsion apparatus including the steering mechanism according to the fourth preferred embodiment of the present invention.

FIG. 18 is a partial sectional view of a portion of a marine vessel propulsion apparatus 401 including a steering mechanism 420 according to a fourth preferred embodiment of the present invention. FIG. 19 and FIG. 20 are schematic plan views of a portion of the first marine vessel propulsion apparatus 401 including the steering mechanism 420 according to the fourth preferred embodiment of the present invention. In FIG. 18 to FIG. 20, components equivalent to those shown in FIG. 1 to FIG. 17 described above are provided with the same reference numerals as in FIG. 1, etc., and description thereof will be omitted.

A major difference between the fourth preferred embodiment and the above-described first preferred embodiment is that the steering mechanism 420 is provided instead of the steering mechanism 20. The steering mechanism 420 includes the electric motor 37, a power conversion mechanism 438, the reduction gear mechanism 39, and the steering case 40. The rotation of the electric motor 37 is converted into turning of the steering shaft 11 around the steering axis L3 by a first drive gear 465 and a first driven gear 466.

In detail, the power conversion mechanism 438 includes the first drive gear 465 that is driven to rotate by the electric motor 37, and the first driven gear 466 engaged with the first drive gear 465. The first drive gear 465 is, for example, a worm, and the first driven gear 466 is, for example, a worm wheel.

The first drive gear 465 extends in the right-left direction inside the steering case 40. The rotational axis of the first drive gear 465 and the rotational axis of the electric motor 37 are parallel or substantially parallel to each other. The first drive gear 465 is disposed rearward relative to the electric motor 37. Both end portions of the first drive gear 465 are supported on the steering case 40 via the bearings 49. The first drive gear 465 is rotatable around the central axis of the first drive gear 465 with respect to the steering case 40. The central axis (rotational axis) of the first drive gear 465 is a first non-crossing axis L405 that is not parallel to and does not cross the steering axis L3. The first drive gear 465 is joined to the transom bracket 10 via the steering case 40, and joined to the electric motor 37 via the reduction gear mechanism 39. The rotation of the electric motor 37 is transmitted to the first drive gear 465 via the reduction gear mechanism 39. Accordingly, the first drive gear 465 is driven to rotate around the first non-crossing axis L405 by the electric motor 37.

The first driven gear 466 projects from the outer peripheral portion of the intermediate portion 18. The first driven gear 466 has, for example, a fan shape having a first central axis L406 positioned on the steering axis L3. The first driven gear 466 is, for example, integral with the intermediate portion 18. The first driven gear 466 and the intermediate portion 18 may constitute an integral member, or a member including a plurality of divided bodies joined integrally. The first driven gear 466 enters the inside of the steering case 40 through the steering opening 50 and the transom opening 51. The first driven gear 466 turns around the steering axis L3 together with the steering shaft 11.

The rotation of the electric motor 37 is transmitted to the first drive gear 465 by the reduction gear mechanism 39. When the first drive gear 465 rotates around the first non-crossing axis L405, the first driven gear 466 turns around the steering axis L3, and the position of engagement between the first drive gear 465 and the first driven gear 466 moves. Accordingly, the rotation of the electric motor 37 is converted into turning of the steering shaft 11 around the steering axis L3 by the first drive gear 465 and the first driven gear 466. Therefore, the outboard motor 2 turns around the steering axis L3 with respect to the transom bracket 10.

Fifth Preferred Embodiment

Figure 21:
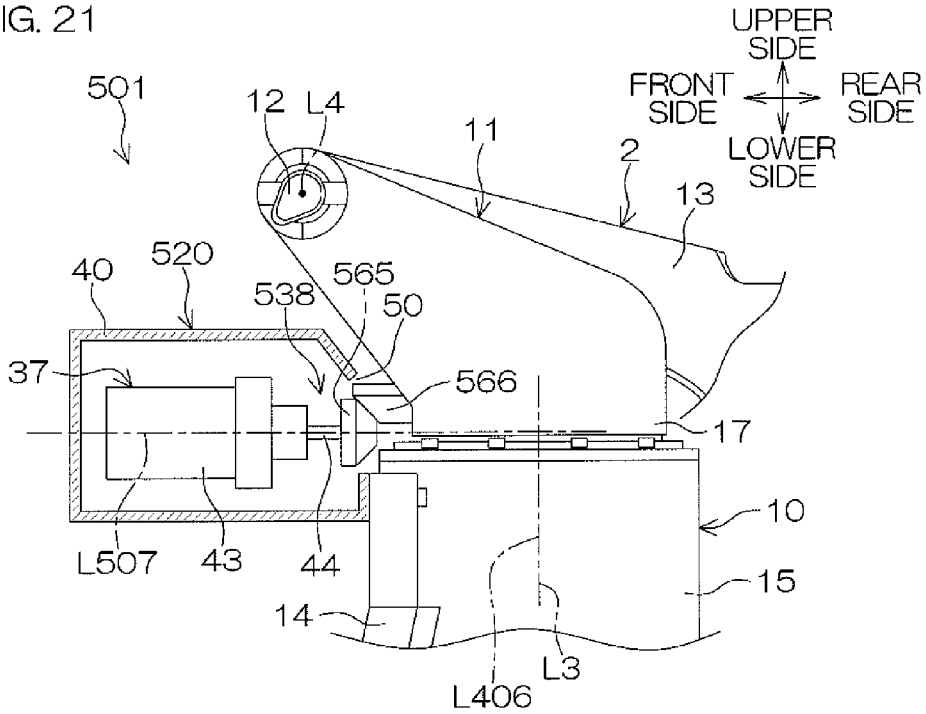
FIG. 21 is a partial sectional view of a portion of a first marine vessel propulsion apparatus including a steering mechanism according to a fifth preferred embodiment of the present invention.
Figure 22:
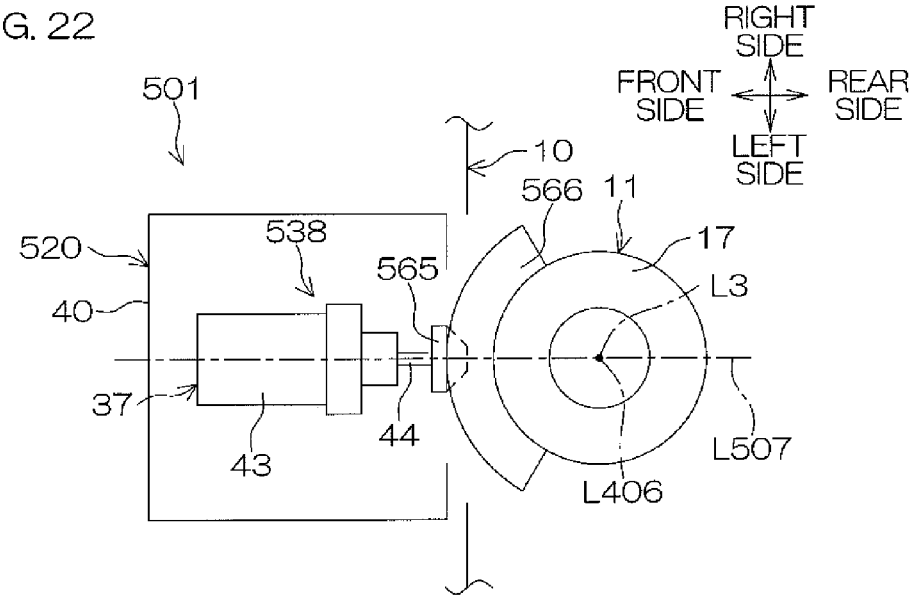
FIG. 22 is a schematic plan view of a portion of the first marine vessel propulsion apparatus including the steering mechanism according to the fifth preferred embodiment of the present invention.
Figure 23:
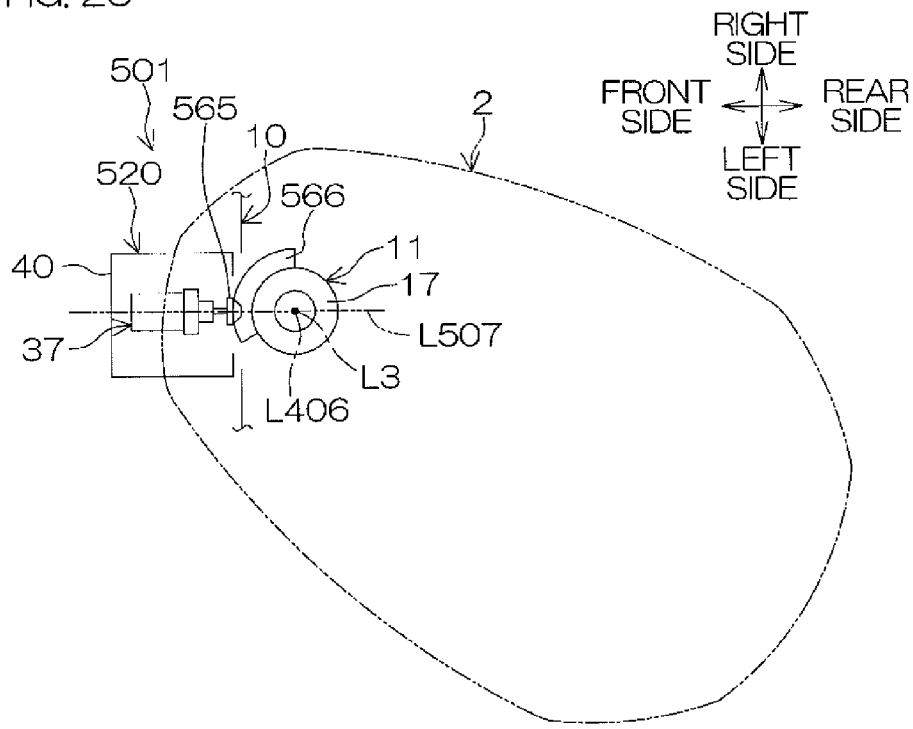
FIG. 23 is a schematic plan view of a portion of the first marine vessel propulsion apparatus including the steering mechanism according to the fifth preferred embodiment of the present invention.

FIG. 21 is a partial sectional view of a portion of a first marine vessel propulsion apparatus 501 including a steering mechanism 520 according to a fifth preferred embodiment of the present invention. FIG. 22 and FIG. 23 are schematic plan views of a portion of the first marine vessel propulsion apparatus 501 including the steering mechanism 520 according to the fifth preferred embodiment of the present invention. In FIG. 21 to FIG. 23, components equivalent to those shown in FIG. 1 to FIG. 20 are provided with the same reference numerals as in FIG. 1, etc., and description thereof will be omitted.

A major difference between the fifth preferred embodiment and the above-described first preferred embodiment is that the steering mechanism 520 is provided instead of the steering mechanism 20. The steering mechanism 520 includes the electric motor 37, a power conversion mechanism 538, and the steering case 40. The rotation of the electric motor 37 is converted into turning of the steering shaft 11 around the steering axis L3 by a first drive gear 565 and a first driven gear 566.

In detail, the power conversion mechanism 538 includes the first drive gear 565 that is driven to rotate by the electric motor 37, and the first driven gear 566 engaged with the first drive gear 565. The first drive gear 565 and the first driven gear 566 are, for example, bevel gears.

The first drive gear 565 is joined to the rotary shaft 44 of the electric motor 37. The first drive gear 565 is disposed coaxially with the rotary shaft 44. The first reduction gear 52 rotates together with the rotary shaft 44. By the electric motor 37, the first drive gear 565 is driven to rotate around a first crossing axis L507 that crosses the steering axis L3. Specifically, the electric motor 37 is disposed so that the rotary shaft 44 extends in the front-rear direction. The motor main body 43 of the electric motor 37 is fixed to the steering case 40. The electric motor 37 is fixed to the transom bracket 10 via the steering case 40. Therefore, the first drive gear 565 is joined to the transom bracket 10 via the electric motor 37 and the steering case 40.

The first driven gear 566 is joined to the joint portion 17 of the steering shaft 11. The first driven gear 566 has, for example, a fan shape having a first central axis L406 positioned on the steering axis L3. The first driven gear 566 turns around the steering axis L3 together with the steering shaft 11. The rotation of the electric motor 37 is transmitted to the first driven gear 566 via the first drive gear 565. When the first drive gear 565 rotates around the first crossing axis L507, the first driven gear 566 turns around the steering axis L3, and the position of engagement between the first drive gear 565 and the first driven gear 566 moves. Accordingly, the rotation of the electric motor 37 is converted into turning of the steering shaft 11 around the steering axis L3 by the first drive gear 565 and the first driven gear 566. Therefore, the outboard motor 2 turns around the steering axis L3 with respect to the transom bracket 10.

Second Marine Vessel Propulsion Apparatus

Next, a second marine vessel propulsion apparatus including an electric motor fixed to the steering shaft will be described. In the description given below, components equivalent to those shown in FIG. 1 to FIG. 23 are provided with the same reference numerals as in FIG. 1, etc., and description thereof will be omitted.

Sixth Preferred Embodiment

Figure 24:
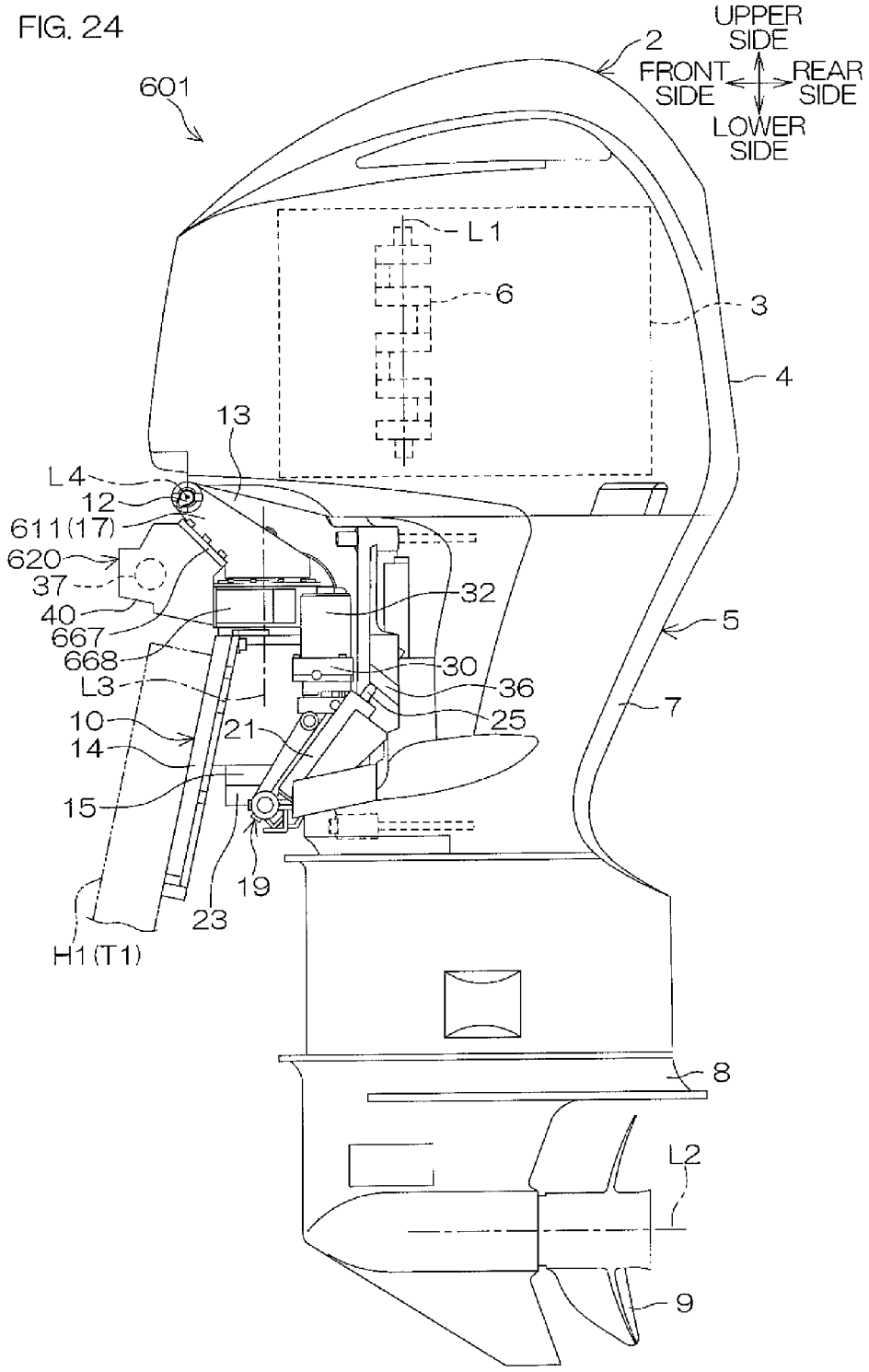
FIG. 24 is a side view of a second marine vessel propulsion apparatus according to a sixth preferred embodiment of the present invention.
Figure 25A:
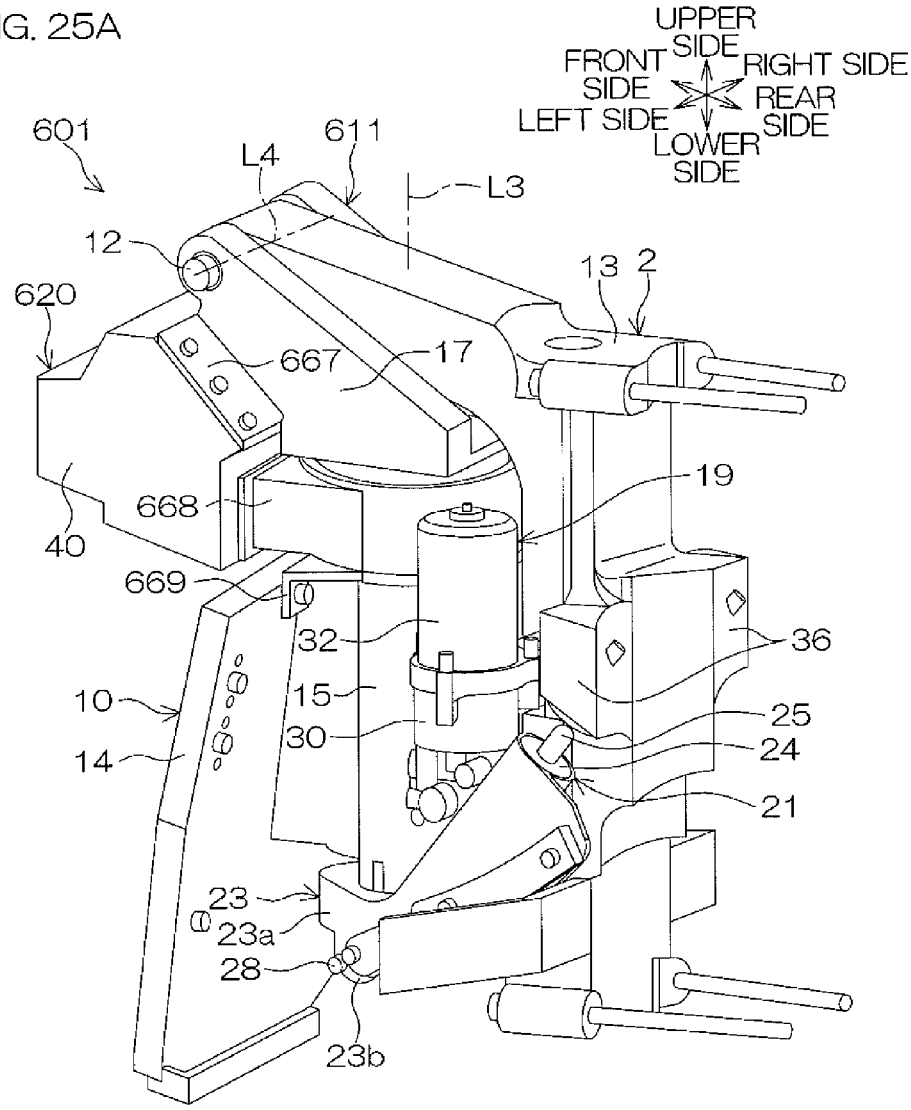
FIG. 25A is a perspective view of a portion of the second marine vessel propulsion apparatus according to the sixth preferred embodiment of the present invention.
Figure 25B:
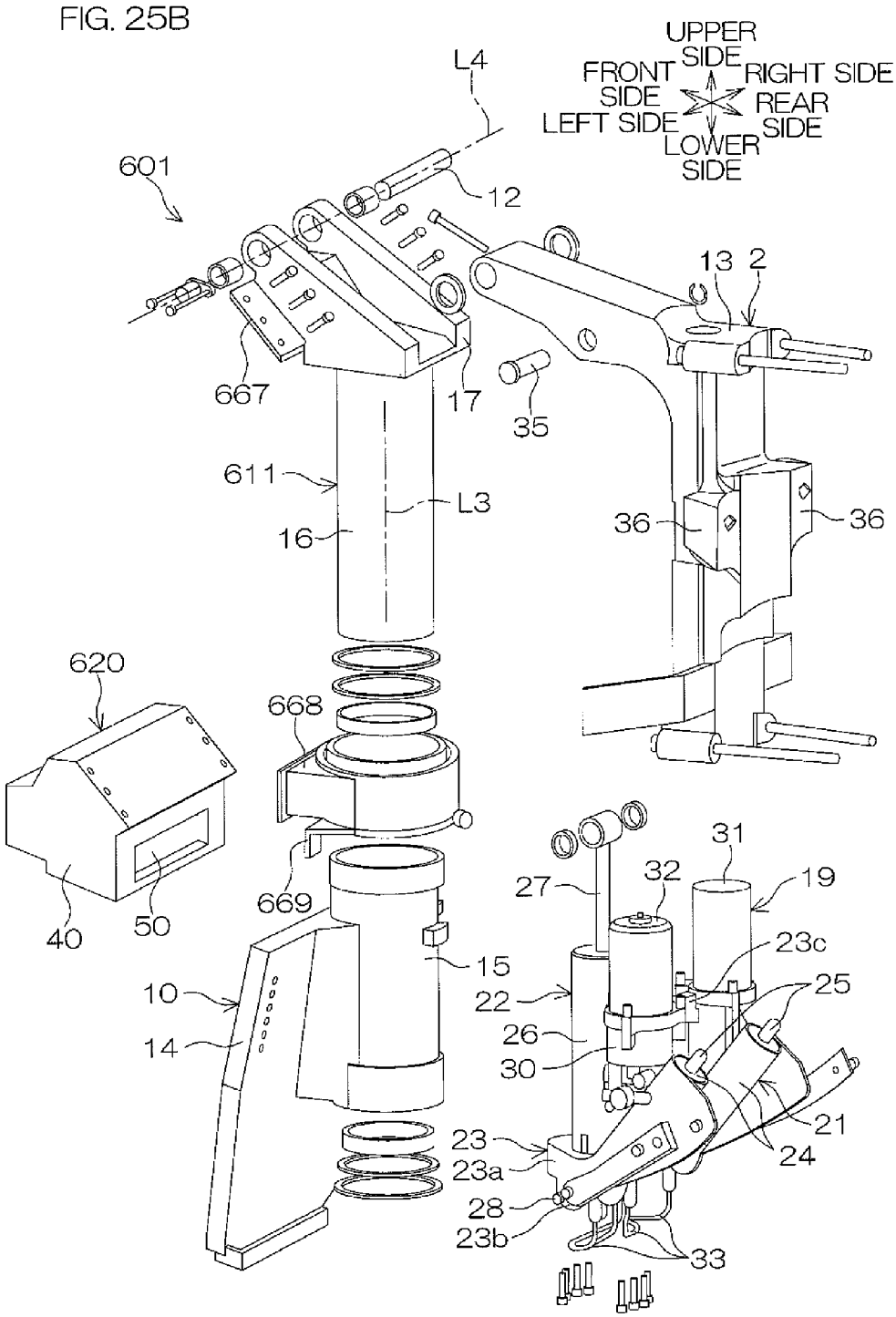
FIG. 25B is an exploded perspective view of a portion of the second marine vessel propulsion apparatus according to the sixth preferred embodiment of the present invention.
Figure 25C:
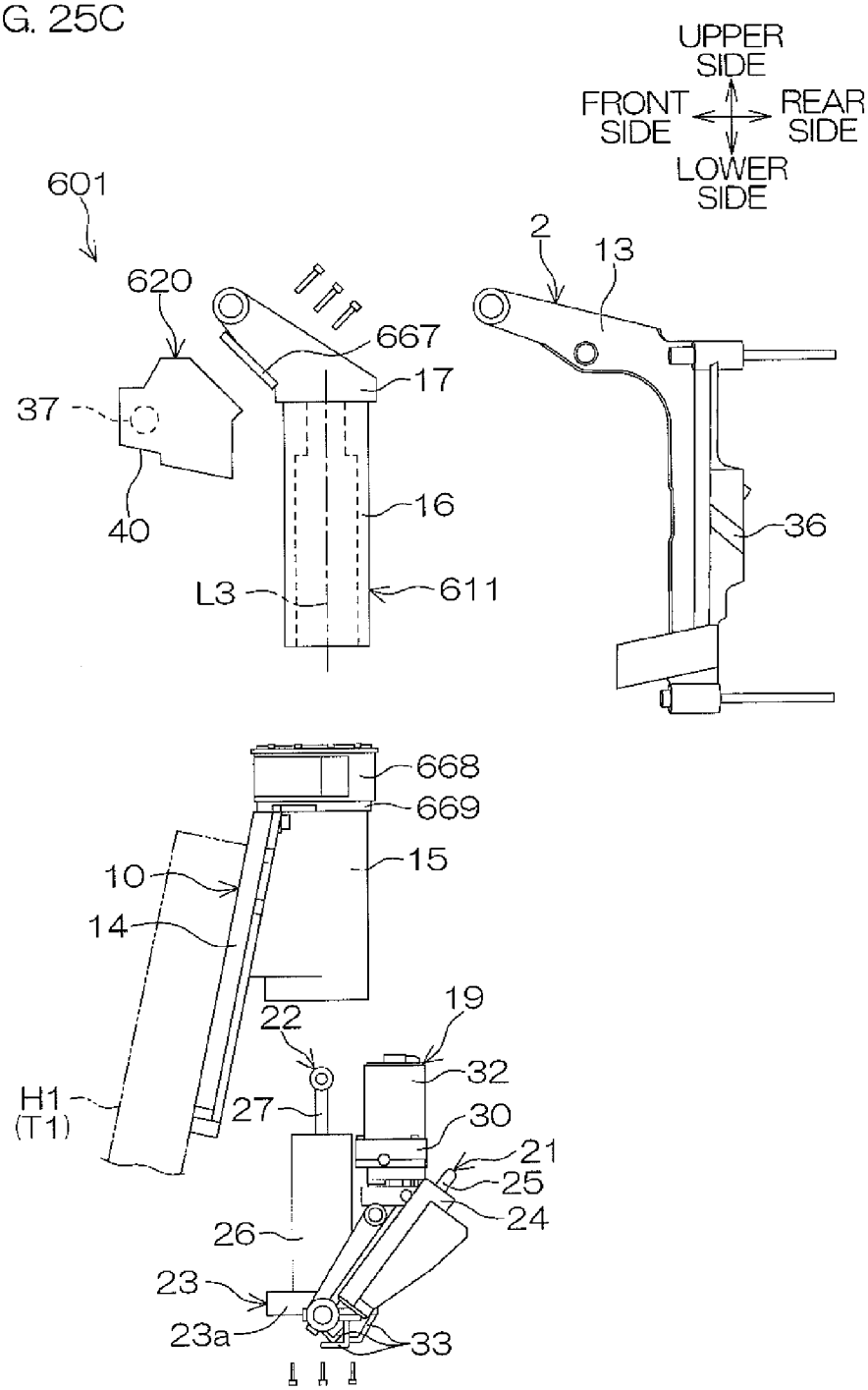
FIG. 25C is an exploded view of a portion of the second marine vessel propulsion apparatus according to the sixth preferred embodiment of the present invention.
Figure 26:
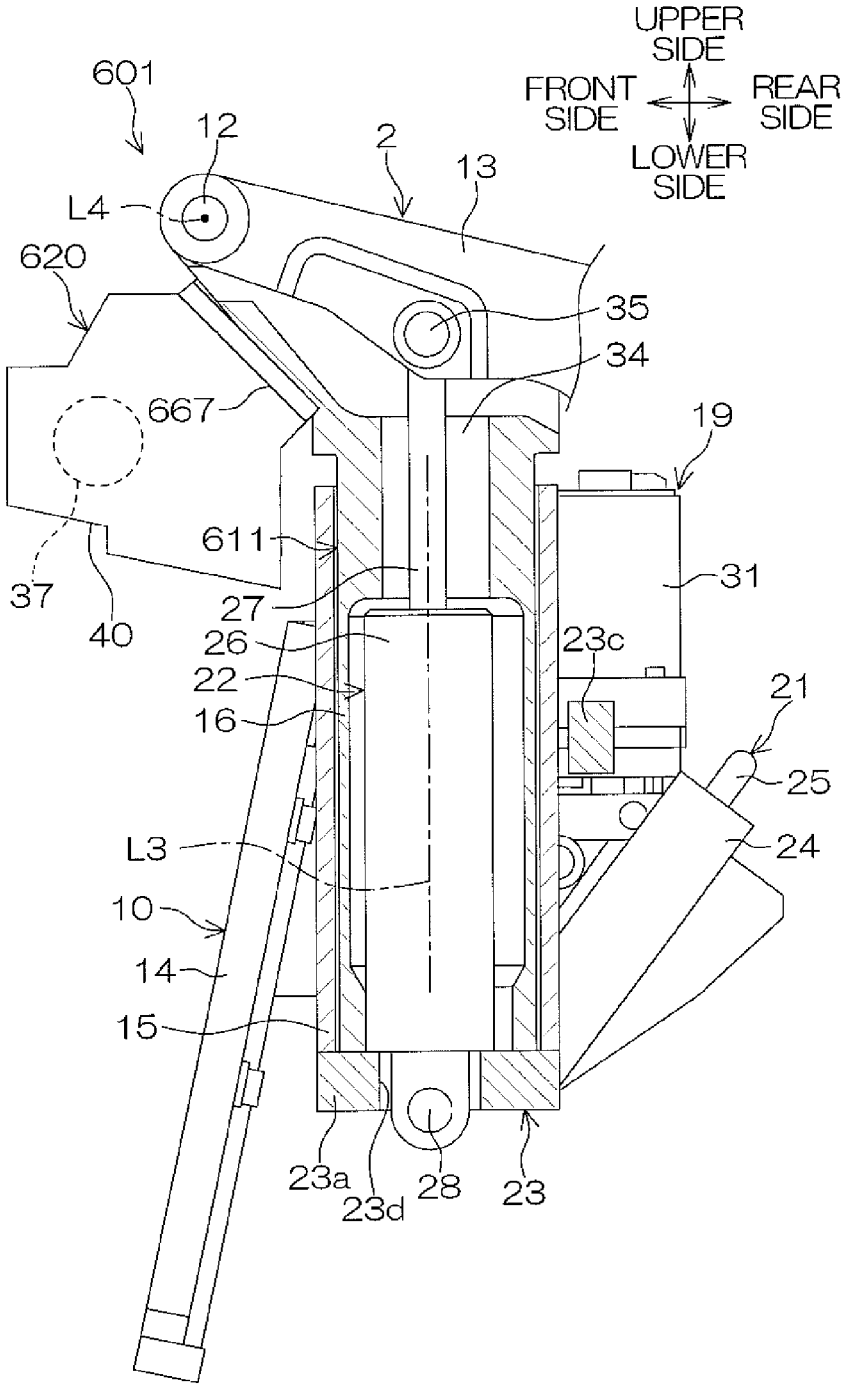
FIG. 26 is a partial sectional view of a portion of the second marine vessel propulsion apparatus according to the sixth preferred embodiment of the present invention.

FIG. 24 is a side view of a second marine vessel propulsion apparatus 601 according to a sixth preferred embodiment of the present invention. FIG. 25A is a perspective view of a portion of the second marine vessel propulsion apparatus 601 according to the sixth preferred embodiment of the present invention. FIG. 25B is an exploded perspective view of a portion of the second marine vessel propulsion apparatus 601 according to the sixth preferred embodiment of the present invention. FIG. 25C is an exploded view of a portion of the second marine vessel propulsion apparatus 601 according to the sixth preferred embodiment of the present invention. FIG. 26 is a partial side view of a portion of the second marine vessel propulsion apparatus 601 according to the sixth preferred embodiment of the present invention.

The second marine vessel propulsion apparatus 601 includes the outboard motor 2, the transom bracket 10, a steering shaft 611, and the tilt shaft 12. The second marine vessel propulsion apparatus 601 further includes the tilt mechanism 19 and a steering mechanism 620. The steering shaft 611 includes the tubular portion 16 and the joint portion 17. The joint portion 17 is joined to the upper end portion of the tubular portion 16. The joint portion 17 is, for example, integral with the tubular portion 16. The tubular portion 16 and the joint portion 17 may constitute an integral member, or may constitute a member including a plurality of divided bodies joined integrally. Specifically, the steering shaft 611 may be a member including a plurality of divided bodies, or may be an integral member. The inside of the tubular portion 16 is connected to the through-hole 34 of the joint portion 17. The cylinder main body 26 of the tilt cylinder 22 is disposed inside the tubular portion 16. The lower end portion of the tubular portion 16 is joined to the frame 23. The upper end portion of the tilt rod 27 projects upward from the through-hole 34 of the joint portion 17. The upper end portion of the tilt rod 27 is joined to the tilt bracket 13 via the upper pin 35.

Figure 27:
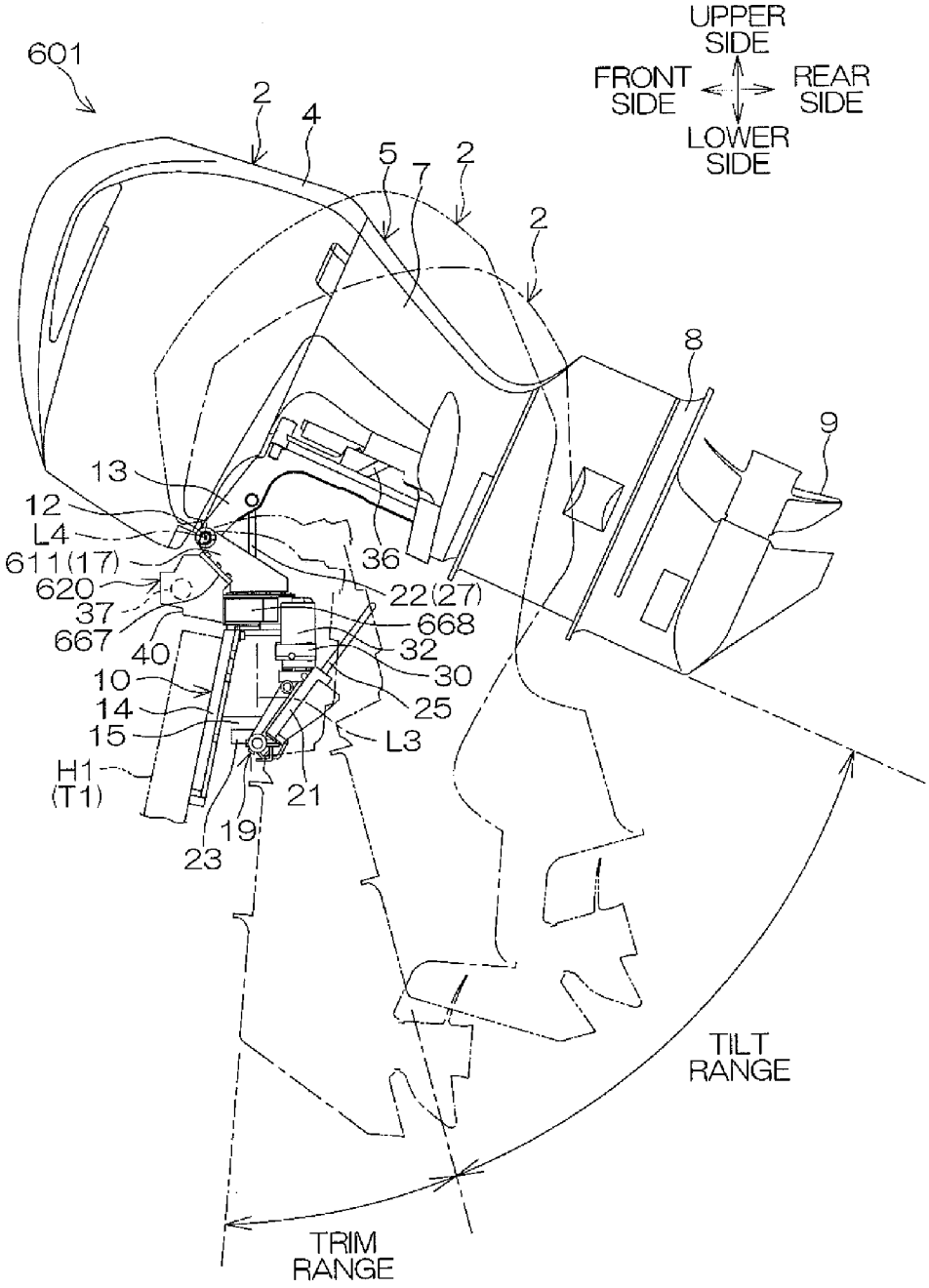
FIG. 27 is a side view of the second marine vessel propulsion apparatus according to the sixth preferred embodiment of the present invention.
Figure 28:
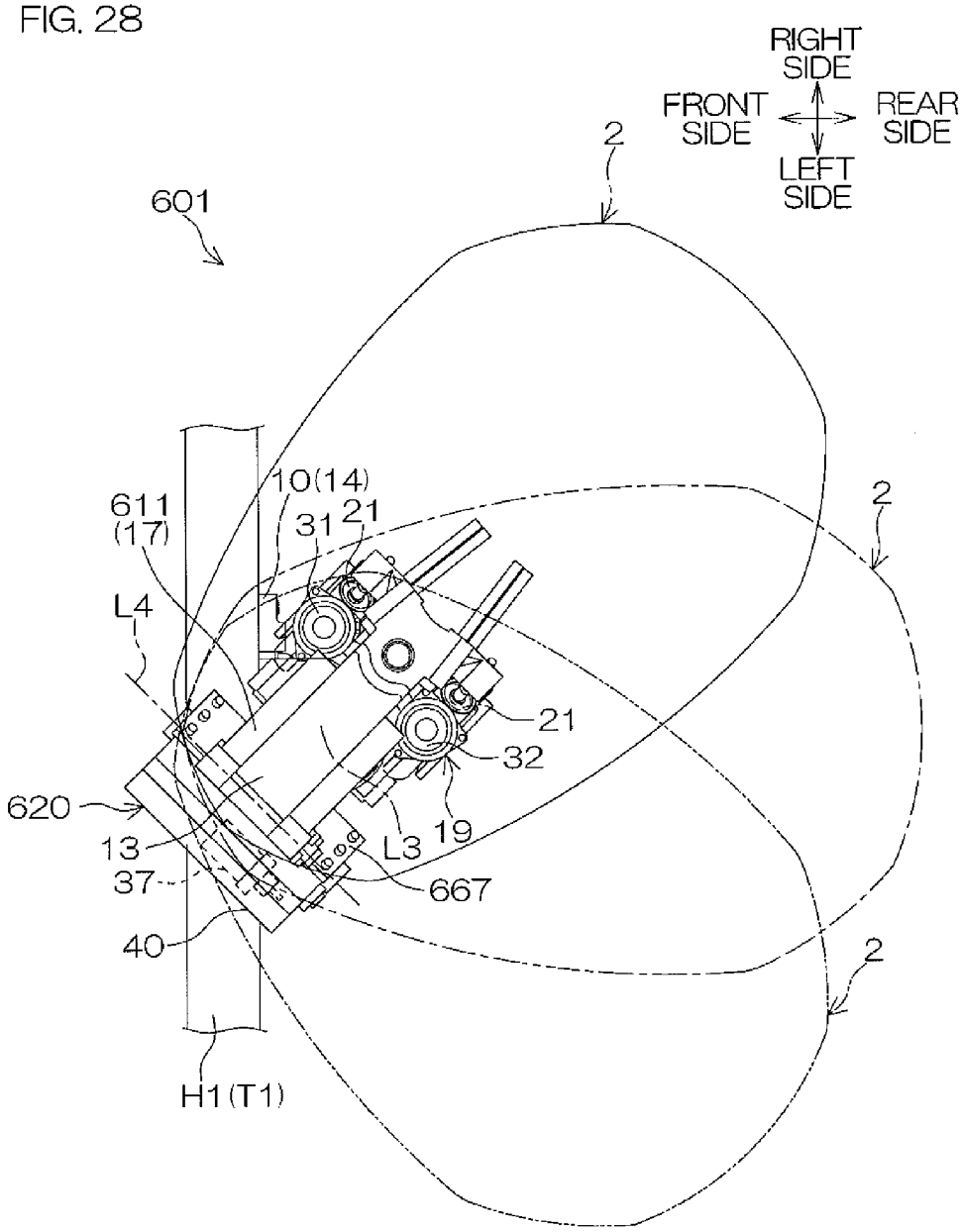
FIG. 28 is a plan view of the second marine vessel propulsion apparatus according to the sixth preferred embodiment of the present invention.

FIG. 27 is a side view of the second marine vessel propulsion apparatus 601 according to the sixth preferred embodiment of the present invention. FIG. 28 is a plan view of the second marine vessel propulsion apparatus 601 according to the sixth preferred embodiment of the present invention. FIG. 28 shows a state in which the outboard motor 2 is positioned at a maximum rightward steering position by the solid line. FIG. 28 shows a state in which the outboard motor 2 is positioned at the steering origin by alternate long and short dashed lines, and shows a state in which the outboard motor 2 is positioned at a maximum leftward steering position by the alternate long and two short dashed lines.

The steering shaft 611 further includes a fixing portion 667 provided on the joint portion 17. The steering case 40 is fixed to the fixing portion 667. Therefore, the electric motor 37 is fixed to the steering shaft 611 via the steering case 40. The outboard motor 2 turns around the tilt axis L4 with respect to the steering shaft 611. Therefore, as shown in FIG. 27, when the outboard motor 2 turns around the tilt axis L4 with respect to the transom bracket 10, the electric motor 37 does not turn around the tilt axis L4 with respect to the transom bracket 10. Specifically, when the outboard motor 2 turns around the tilt axis L4 with respect to the transom bracket 10, the position of the electric motor 37 with respect to the outboard motor 2 changes.

On the other hand, the electric motor 37 is fixed to the steering shaft 611, so that when the steering shaft 611 turns around the steering axis L3, the electric motor 37 turns around the steering axis L3 together with the steering shaft 611 and the outboard motor 2. Therefore, as shown in FIG. 28, when the outboard motor 2 turns around the steering axis L3 with respect to the transom bracket 10, the electric motor 37 turns around the steering axis L3 with respect to the transom bracket 10 together with the outboard motor 2. Specifically, even when the outboard motor 2 turns around the steering axis L3 with respect to the transom bracket 10, the position of the electric motor 37 with respect to the outboard motor 2 does not change.

Figure 29:
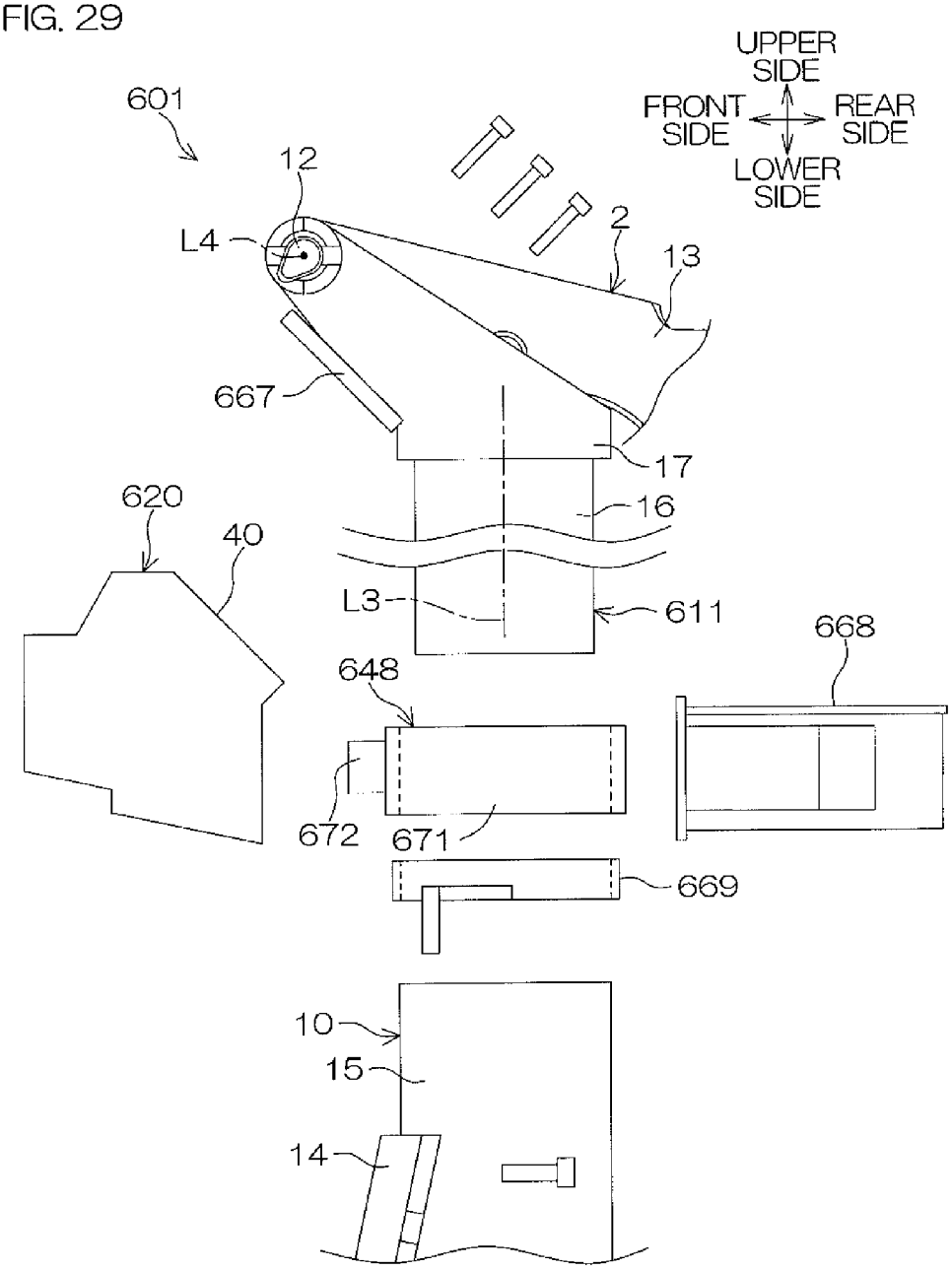
FIG. 29 is an exploded view of a portion of the second marine vessel propulsion apparatus according to the sixth preferred embodiment of the present invention.
Figure 30:
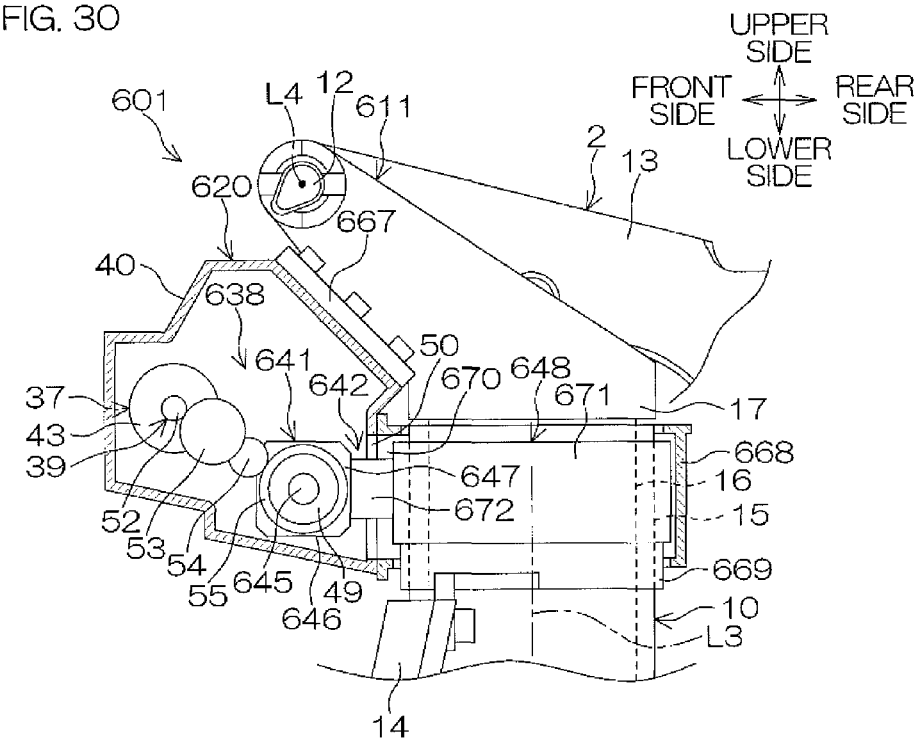
FIG. 30 is a partial sectional view of a portion of the second marine vessel propulsion apparatus including a steering mechanism according to the sixth preferred embodiment of the present invention.
Figure 31:
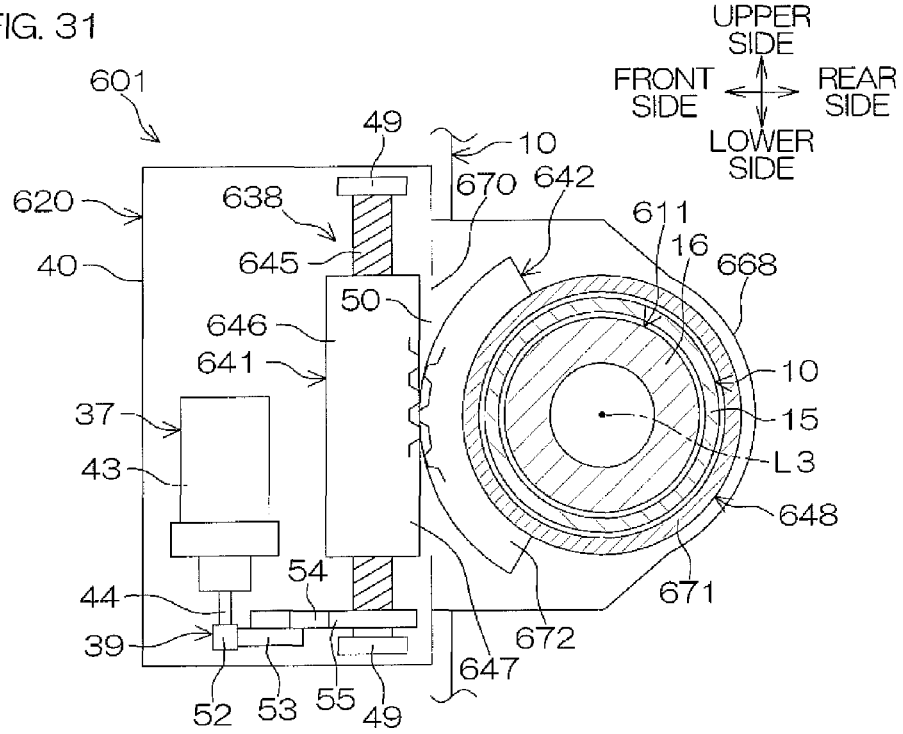
FIG. 31 is a schematic plan view of a portion of the second marine vessel propulsion apparatus including the steering mechanism according to the sixth preferred embodiment of the present invention.
Figure 32:
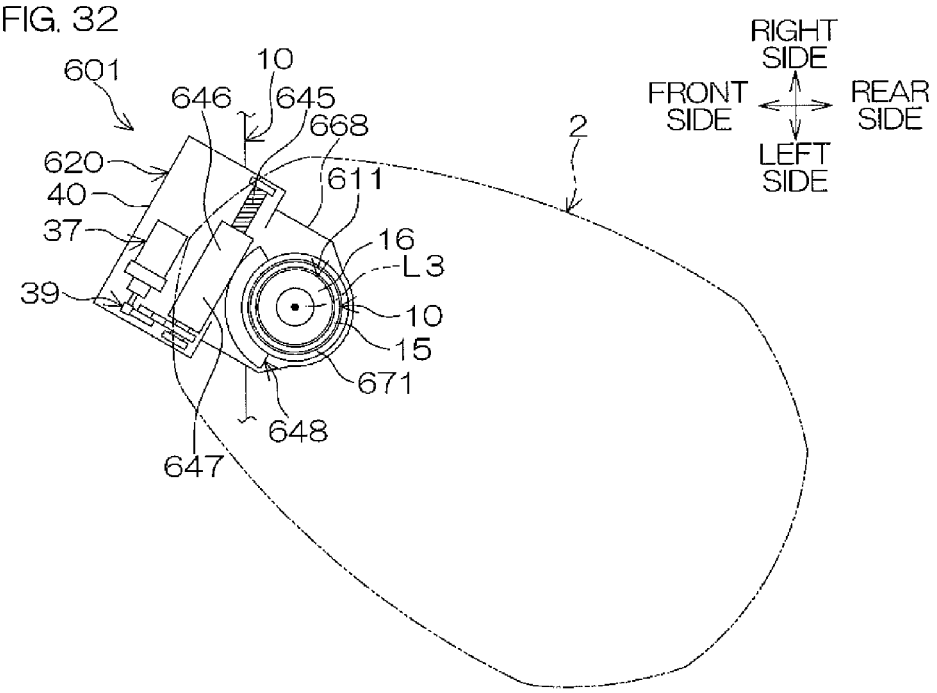
FIG. 32 is a schematic plan view of a portion of the second marine vessel propulsion apparatus including the steering mechanism according to the sixth preferred embodiment of the present invention.

FIG. 29 is an exploded view of a portion of the second marine vessel propulsion apparatus 601 according to the sixth preferred embodiment of the present invention. FIG. 30 is a partial sectional view of a portion of the second marine vessel propulsion apparatus 601 including a steering mechanism 620 according to the sixth preferred embodiment of the present invention. FIG. 31 and FIG. 32 are schematic plan views of a portion of the second marine vessel propulsion apparatus 601 including the steering mechanism 620 according to the sixth preferred embodiment of the present invention.

The steering mechanism 620 includes the electric motor 37, a power conversion mechanism 638, the reduction gear mechanism 39, and the steering case 40. As shown in FIG. 29, the steering mechanism 620 further includes a gear case 668 and a stay 669. The power conversion mechanism 638 includes a first conversion mechanism 641 and a second conversion mechanism 642. As shown in FIG. 30, the steering case 40 is fixed to a fixing portion 667 of the steering shaft 611, and the gear case 668 is fixed to the steering case 40. Therefore, the gear case 668 is fixed to the steering shaft 611 via the steering case 40. The steering shaft 611 is turnable around the steering axis L3 with respect to the transom bracket 10. Therefore, the gear case 668 is turnable around the steering axis L3 with respect to the transom bracket 10. As shown in FIG. 30, the gear case 668 has a gear opening 670 opposed to the steering opening 50. The inside of the steering case 40 is connected to the inside of the gear case 668 via the gear opening 670.

As shown in FIG. 31, the first conversion mechanism 641 includes a second ball screw 645, and a tubular second ball nut 646 attached to the second ball screw 645 via a plurality of balls. The second conversion mechanism 642 includes a second rack 647 joined to the second ball nut 646, and a second pinion 648 engaged with the second rack 647. The second ball screw 645, the second ball nut 646, and the second rack 647 are housed in the steering case 40, and held by the steering case 40. On the other hand, most of the second pinion 648 is housed in the gear case 668. The second pinion 648 is joined to the transom bracket 10. The steering shaft 611 is turnable around the steering axis L3 with respect to the transom bracket 10, so that the steering shaft 611 is turnable around the steering axis L3 with respect to the second pinion 648.

As shown in FIG. 31, the second ball screw 645 extends in the right-left direction inside the steering case 40. The rotational axis of the second ball screw 645 and the rotational axis of the electric motor 37 are parallel or substantially parallel to each other. The second ball screw 645 is disposed rearward relative to the electric motor 37. Both end portions of the second ball screw 645 are supported on the steering case 40 via bearings 49. The second ball screw 645 is joined to the transom bracket 10 via the steering case 40, and joined to the electric motor 37 via the reduction gear mechanism 39. The rotation of the electric motor 37 is transmitted to the second ball screw 645 via the reduction gear mechanism 39. Accordingly, the second ball screw 645 is driven to rotate by the electric motor 37. When the second ball screw 645 rotates around the central axis of the second ball screw 645, the second ball nut 646 moves along the second ball screw 645, and the rotation of the second ball screw 645 is converted into linear motion of the second ball nut 646 with respect to the second ball screw 645.

As shown in FIG. 31, the second rack 647 is provided on the outer peripheral portion of the second ball nut 646. The second rack 647 is, for example, integral with the second ball nut 646. The second rack 647 and the second ball nut 646 may constitute an integral member, or may constitute a member including a plurality of divided bodies joined integrally. The second rack 647 includes a plurality of teeth aligned in the axial direction of the second ball screw 645. The second rack 647 is opposed to the steering opening 50 provided in the steering case 40. When the second ball screw 645 rotates, the second rack 647 moves along the second ball screw 645 together with the second ball nut 646.

As shown in FIG. 31, the second pinion 648 includes a cylindrical portion 671 and a gear portion 672. As shown in FIG. 30, the cylindrical portion 671 of the second pinion 648 is fixed to the stay 669. The stay 669 is fixed to the transom bracket 10. Therefore, the second pinion 648 is fixed to the transom bracket 10 via the stay 669. The stay 669 is tubular. The stay 669 and the cylindrical portion 671 are disposed coaxially with each other. The inside of the stay 669 is connected to the inside of the cylindrical portion 671. As shown in FIG. 30, the housing portion 15 of the transom bracket 10 is inserted into the cylindrical portion 671 and the stay 669. The cylindrical portion 671 and the stay 669 surround the housing portion 15 around the steering axis L3.

As shown in FIG. 30 and FIG. 31, the second pinion 648 is covered by the gear case 668. The gear case 668 is disposed around the second pinion 648. The gear portion 672 of the second pinion 648 projects from the outer peripheral portion of the cylindrical portion 671. The gear portion 672 has, for example, a fan shape having a central axis positioned on the steering axis L3. The gear portion 672 enters the inside of the steering case 40 through the steering opening 50 and the gear opening 670. The gear portion 672 engages with the second rack 647 inside the steering case 40. The rotation of the electric motor 37 is converted into turning of the steering shaft 611 around the steering axis L3 by the second ball screw 645, the second ball nut 646, the second rack 647, and the second pinion 648.

In detail, the rotation of the electric motor 37 is transmitted to the second ball screw 645 by the reduction gear mechanism 39. When the second ball screw 645 rotates, a force of relative movement in the axial direction of the second ball screw 645 is applied to the second ball screw 645 and the second ball nut 646. According to movement of the position of engagement between the second rack 647 and the second pinion 648, the force is converted into a force that turns the second ball screw 645 and the second ball nut 646 around the steering axis L3. Accordingly, as shown in FIG. 32, the second ball screw 645 and the second ball nut 646 turn around the steering axis L3 while the second ball screw 645 moves in the axial direction of the second ball screw 645 with respect to the second ball nut 646.

The second ball screw 645 is joined to the steering shaft 611 via the steering case 40. Therefore, the second ball screw 645 turns around the steering axis L3, and accordingly, the steering shaft 611 turns around the steering axis L3 with respect to the transom bracket 10. Specifically, the rotation of the electric motor 37 is converted into linear motion of the second ball nut 646 with respect to the second ball screw 645 by the second ball screw 645 and the second ball nut 646. Concurrently, the linear motion of the second ball nut 646 is converted into turning of the steering shaft 611 around the steering axis L3 by the second rack 647 and the second pinion 648. Accordingly, as shown in FIG. 32, the outboard motor 2 turns around the steering axis L3 with respect to the transom bracket 10.

Seventh Preferred Embodiment

Figure 33:
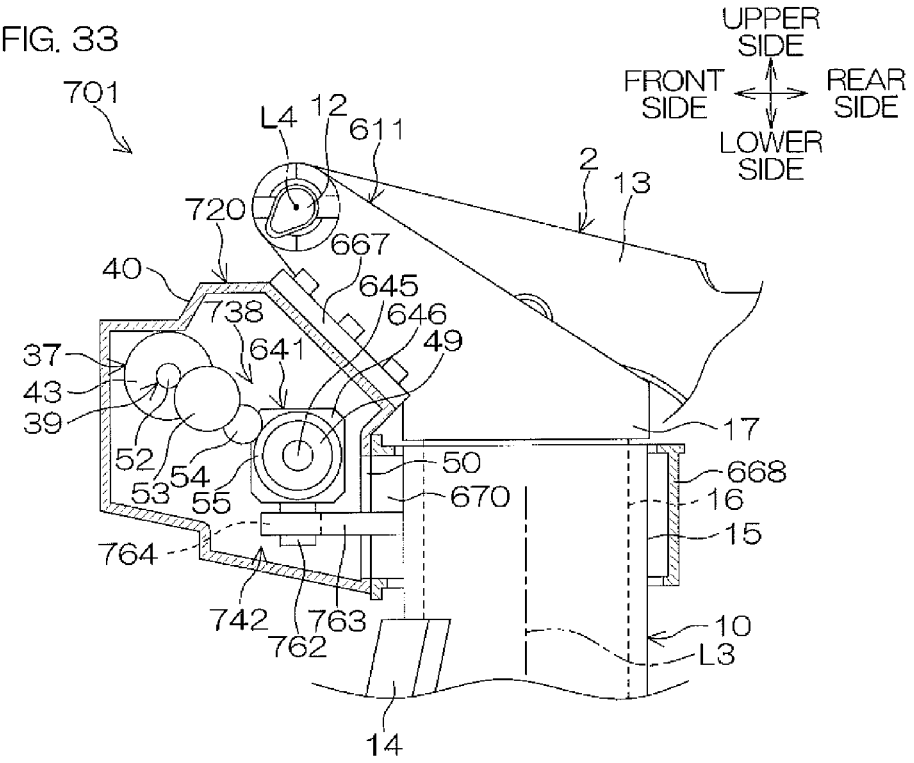
FIG. 33 is a partial sectional view of a portion of a second marine vessel propulsion apparatus including a steering mechanism according to a seventh preferred embodiment of the present invention.
Figure 34:
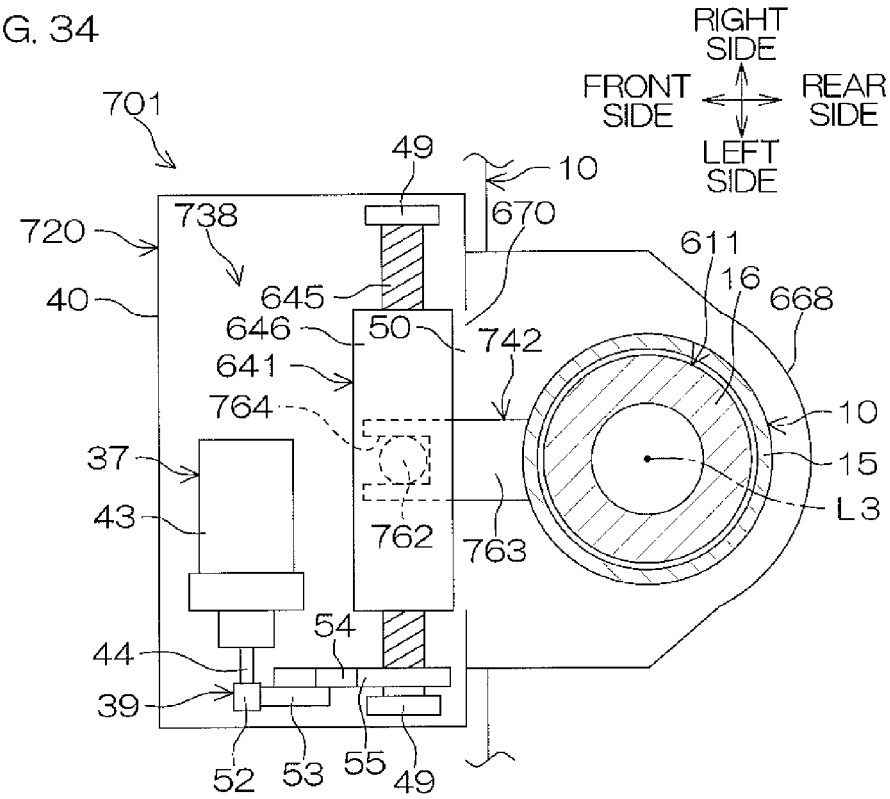
FIG. 34 is a schematic plan view of a portion of the second marine vessel propulsion apparatus including the steering mechanism according to the seventh preferred embodiment of the present invention.
Figure 35:
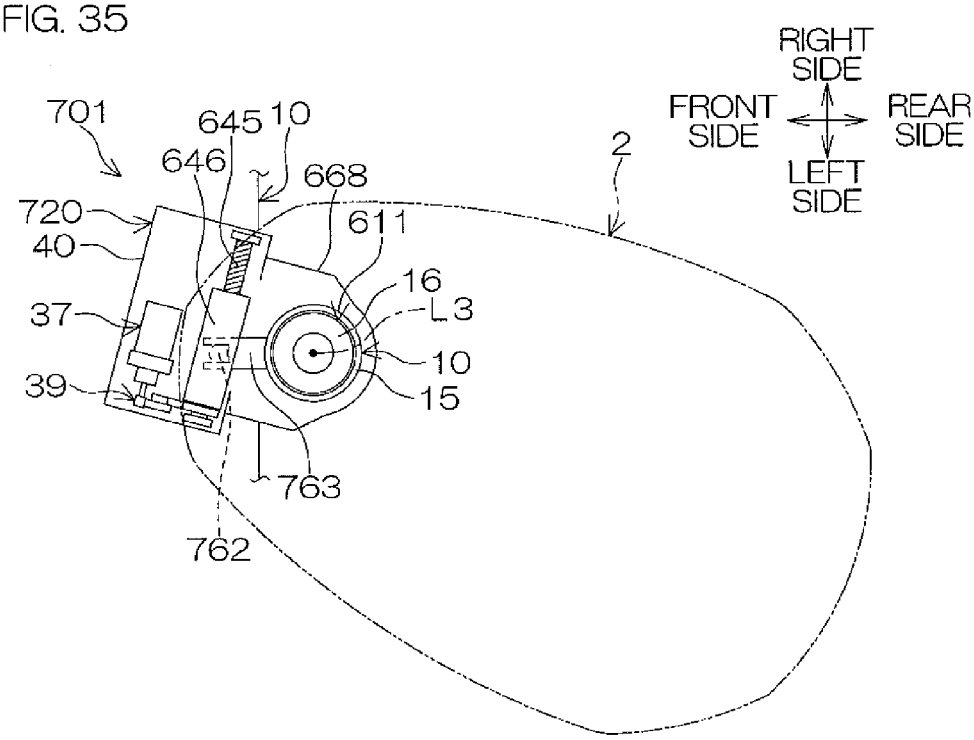
FIG. 35 is a schematic plan view of a portion of the second marine vessel propulsion apparatus including the steering mechanism according to the seventh preferred embodiment of the present invention.

FIG. 33 is a partial sectional view of a portion of a second marine vessel propulsion apparatus 701 including a steering mechanism 720 according to a seventh preferred embodiment of the present invention. FIG. 34 and FIG. 35 are schematic plan views of a portion of the second marine vessel propulsion apparatus 701 including the steering mechanism 720 according to the seventh preferred embodiment of the present invention. In FIG. 33 to FIG. 35, components equivalent to those shown in FIG. 1 to FIG. 32 are provided with the same reference numerals as in FIG. 1, etc., and description thereof will be omitted.

A major difference between the seventh preferred embodiment and the above-described sixth preferred embodiment is that the steering mechanism 720 is provided instead of the steering mechanism 620. The steering mechanism 720 includes the electric motor 37, a power conversion mechanism 738, the reduction gear mechanism 39, and the steering case 40. The power conversion mechanism 738 includes the first conversion mechanism 641 and a second conversion mechanism 742. Linear motion of the second ball nut 646 is converted into turning of the steering shaft 611 around the steering axis L3 by a second pin 762 and a second arm 763.

In detail, the second conversion mechanism 742 includes the second pin 762 joined to the second ball nut 646, and the second arm 763 joined to the second pin 762 and the transom bracket 10. For example, the second pin 762 projects downward from the second ball nut 646. The second pin 762 is housed in the steering case 40. When the second ball screw 645 rotates, the second pin 762 moves along the second ball screw 645 together with the second ball nut 646. The second arm 763 projects from the housing portion 15 of the transom bracket 10. The second arm 763 is, for example, integral with the housing portion 15. The second arm 763 and the housing portion 15 may constitute an integral member, or may constitute a member including a plurality of divided bodies joined integrally. The second arm 763 enters the inside of the steering case 40 through the steering opening 50 and the gear opening 670. The second arm 763 includes a forked engagement portion 764. The second pin 762 is disposed inside the engagement portion 764.

The rotation of the electric motor 37 is transmitted to the second ball screw 645 by the reduction gear mechanism 39. When the second ball screw 645 rotates, a force of relative movement in the axial direction of the second ball screw 645 is applied to the second ball screw 645 and the second ball nut 646. By relative turning of the second pin 762 and the second arm 763 around the central axis of the second pin 762, the force is converted into a force that turns the second ball screw 645 and the second ball nut 646 around the steering axis L3. Specifically, the rotation of the electric motor 37 is converted into linear motion of the second ball nut 646 with respect to the second ball screw 645 by the second ball screw 645 and the second ball nut 646. Concurrently, the linear motion of the second ball nut 646 is converted into turning of the steering shaft 611 around the steering axis L3 by the second pin 762 and the second arm 763. Accordingly, the outboard motor 2 turns around the steering axis L3 with respect to the transom bracket 10.

Eighth Preferred Embodiment

Figure 36:
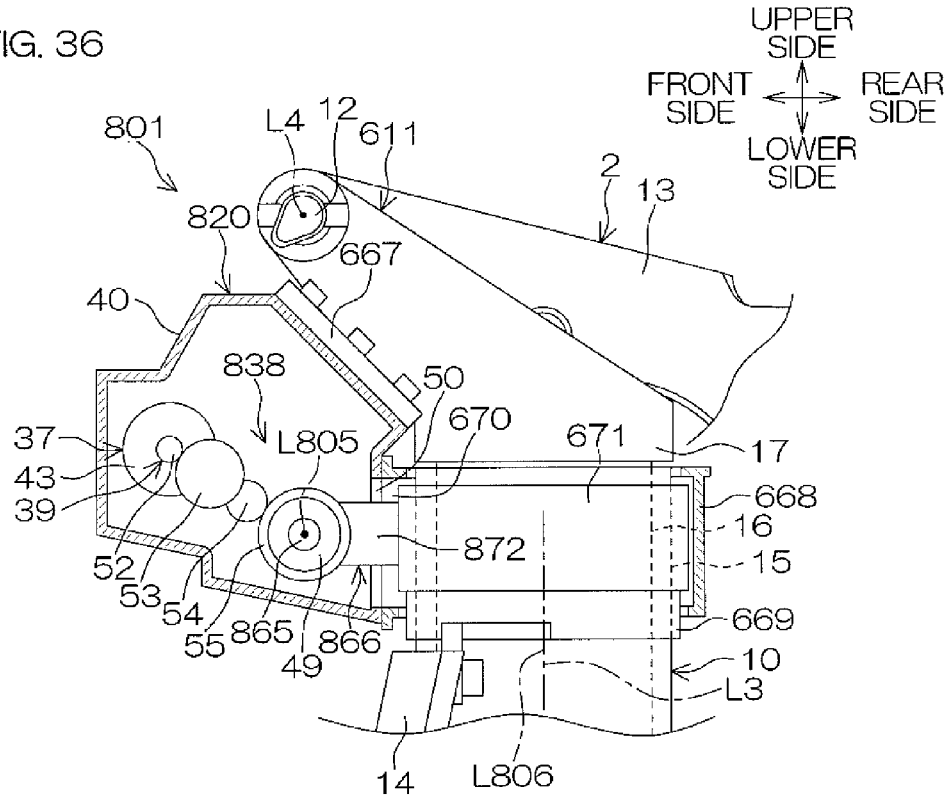
FIG. 36 is a partial sectional view of a portion of a second marine vessel propulsion apparatus including a steering mechanism according to an eighth preferred embodiment of the present invention.
Figure 37:
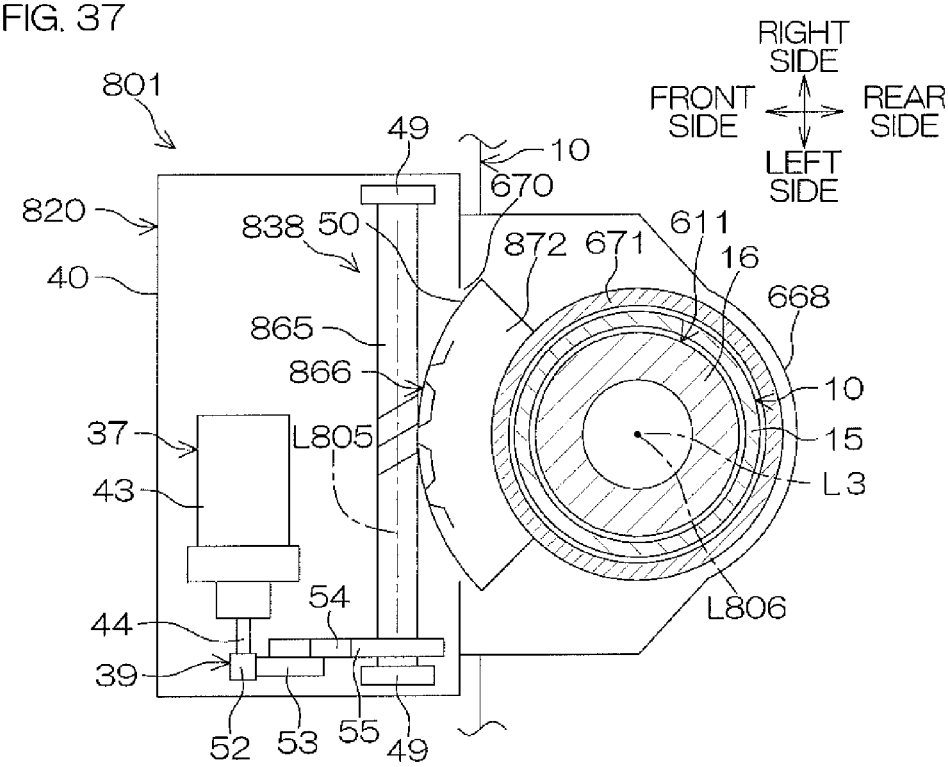
FIG. 37 is a schematic plan view of a portion of the second marine vessel propulsion apparatus including the steering mechanism according to the eighth preferred embodiment of the present invention.
Figure 38:
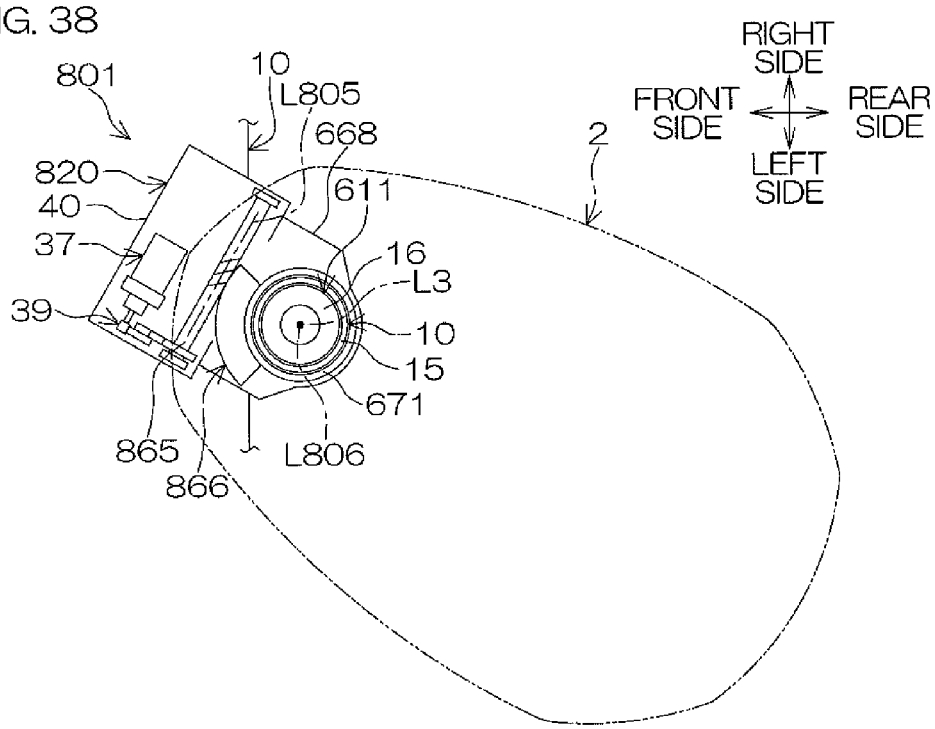
FIG. 38 is a schematic plan view of a portion of the second marine vessel propulsion apparatus including the steering mechanism according to the eighth preferred embodiment of the present invention.

FIG. 36 is a partial sectional view of a portion of a second marine vessel propulsion apparatus 801 including a steering mechanism 820 according to an eighth preferred embodiment of the present invention. FIG. 37 and FIG. 38 are schematic plan views of a portion of the second marine vessel propulsion apparatus 801 including the steering mechanism 820 according to the eighth preferred embodiment of the present invention. In FIG. 36 to FIG. 38, components equivalent to those shown in FIG. 1 to FIG. 35 are provided with the same reference numerals as in FIG. 1, etc., and description thereof will be omitted.

A major difference between the eighth preferred embodiment and the above-described sixth preferred embodiment is that the steering mechanism 820 is provided instead of the steering mechanism 620. The steering mechanism 820 includes the electric motor 37, a power conversion mechanism 838, the reduction gear mechanism 39, and the steering case 40. The rotation of the electric motor 37 is converted into turning of the steering shaft 611 around the steering axis L3 by a second drive gear 865 and a second driven gear 866.

In detail, the power conversion mechanism 838 includes the second drive gear 865 that is driven to rotate by the electric motor 37, and the second driven gear 866 engaged with the second driven gear 865. The second drive gear 865 is, for example, a worm, and the second driven gear 866 is, for example, a worm wheel.

The second drive gear 865 extends in the right-left direction inside the steering case 40. The rotational axis of the second drive gear 865 and the rotational axis of the electric motor 37 are parallel or substantially parallel to each other. The second drive gear 865 is disposed rearward relative to the electric motor 37. Both end portions of the second drive gear 865 are supported on the steering case 40 via bearings 49. The second drive gear 865 is rotatable around the central axis of the second drive gear 865 with respect to the steering case 40. The central axis (rotational axis) of the second drive gear 865 is a second non-crossing axis L805 that is not parallel to and does not cross the steering axis L3. The second drive gear 865 is joined to the steering shaft 611 via the steering case 40, and joined to the electric motor 37 via the reduction gear mechanism 39. The rotation of the electric motor 37 is transmitted to the second drive gear 865 via the reduction gear mechanism 39. Accordingly, the second drive gear 865 is driven to rotate around the second non-crossing axis L805 by the electric motor 37.

The second driven gear 866 includes the cylindrical portion 671 and a gear portion 872. The second driven gear 866 is fixed to the transom bracket 10 via the stay 669. The second driven gear 866 is covered by the gear case 668. The gear case 668 is disposed around the second driven gear 866. The gear portion 872 of the second driven gear 866 projects from the outer peripheral portion of the cylindrical portion 671. The gear portion 872 has, for example, a fan shape having a second central axis L806 positioned on the steering axis L3. The gear portion 872 enters the inside of the steering case 40 through the steering opening 50 and the gear opening 670. The gear portion 872 engages with the second rack 647 inside the steering case 40. The rotation of the electric motor 37 is converted into turning of the steering shaft 611 around the steering axis L3 by the second drive gear 865 and the second driven gear 866.

In detail, the rotation of the electric motor 37 is transmitted to the second drive gear 865 by the reduction gear mechanism 39. The second driven gear 866 is fixed to the transom bracket 10, so that when the second drive gear 865 rotates around the second non-crossing axis L805, a force that moves the second drive gear 865 in the axial direction of the second drive gear 865 is applied. This force is converted into a force that turns the second drive gear 865 around the steering axis L3 by movement of the position of engagement between the second drive gear 865 and the second driven gear 866. The second drive gear 865 is joined to the steering shaft 611 by the electric motor 37 and the steering case 40. Therefore, according to turning of the second drive gear 865 around the steering axis L3, the steering shaft 611 turns around the steering axis L3 with respect to the transom bracket 10. Accordingly, the outboard motor 2 turns around the steering axis L3 with respect to the transom bracket 10.

Ninth Preferred Embodiment

Figure 39:
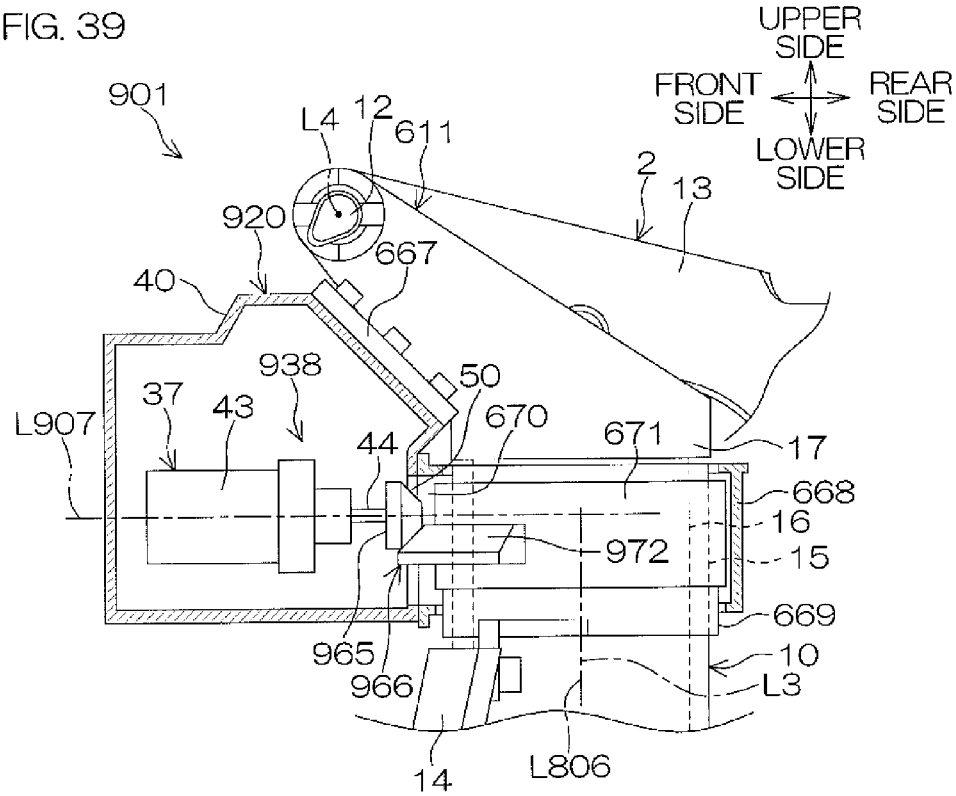
FIG. 39 is a partial sectional view of a portion of a second marine vessel propulsion apparatus including a steering mechanism according to a ninth preferred embodiment of the present invention.
Figure 40:
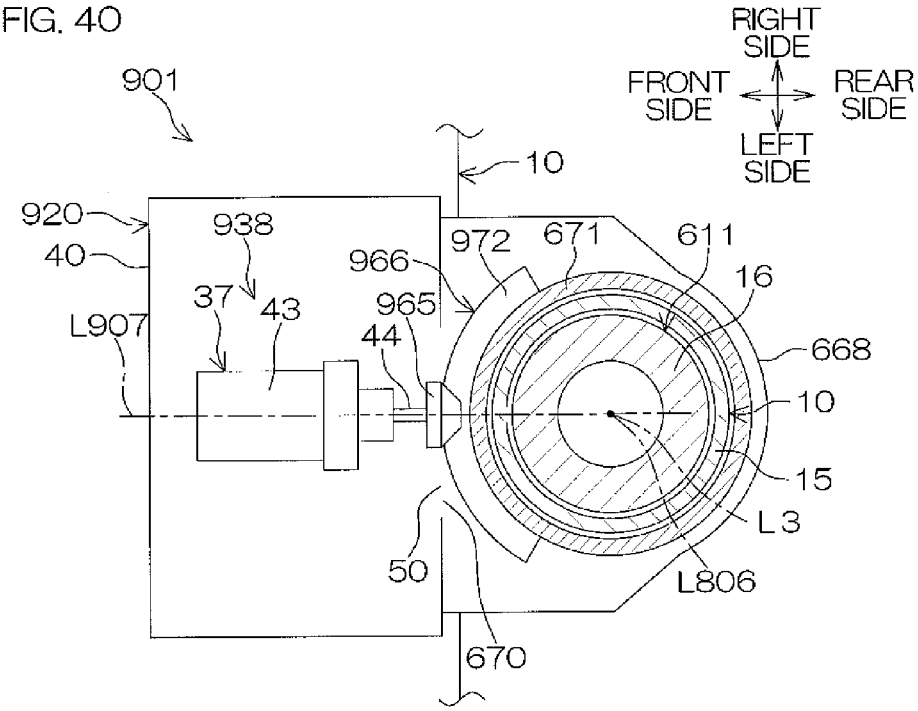
FIG. 40 is a schematic plan view of a portion of the second marine vessel propulsion apparatus including the steering mechanism according to the ninth preferred embodiment of the present invention.
Figure 41:
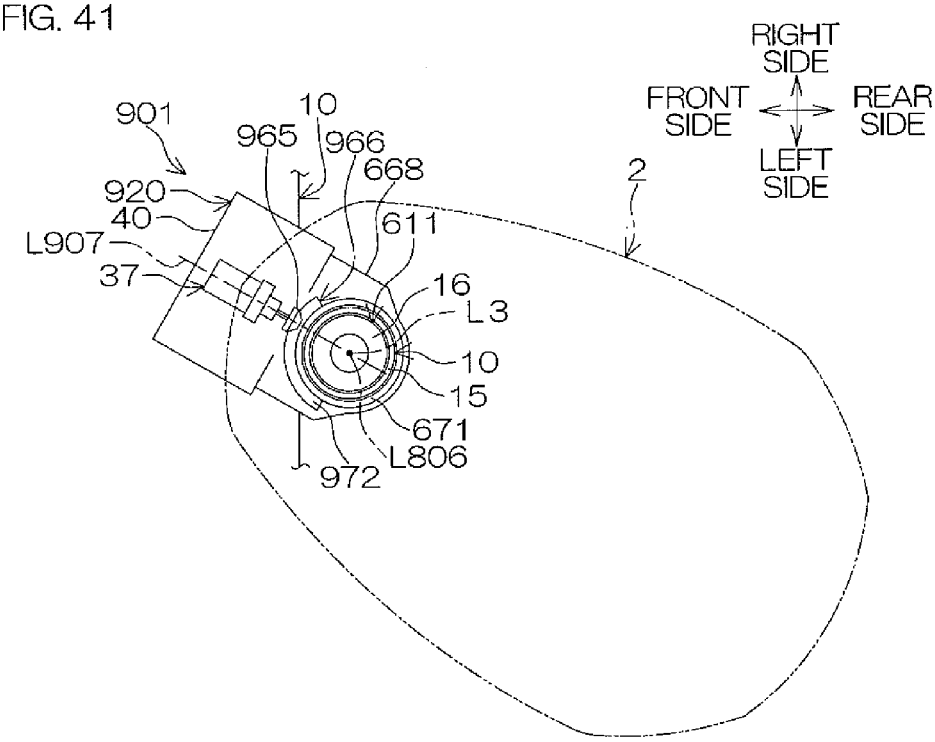
FIG. 41 is a schematic plan view of a portion of the second marine vessel propulsion apparatus including the steering mechanism according to the ninth preferred embodiment of the present invention.

FIG. 39 is a partial sectional view of a portion of a second marine vessel propulsion apparatus including a steering mechanism 920 according to a ninth preferred embodiment of the present invention. FIG. 40 and FIG. 41 are schematic plan views of a portion of the second marine vessel propulsion apparatus 901 including the steering mechanism 920 according to the ninth preferred embodiment of the present invention. In FIG. 39 to FIG. 41, components equivalent to those shown in FIG. 1 to FIG. 38 are provided with the same reference numerals as in FIG. 1, etc., and description thereof will be omitted.

A major difference between the ninth preferred embodiment and the above-described sixth preferred embodiment is that the steering mechanism 920 is provided instead of the steering mechanism 620. The steering mechanism 920 includes the electric motor 37, a power conversion mechanism 938, and the steering case 40. The rotation of the electric motor 37 is converted into turning of the steering shaft 611 around the steering axis L3 by a second drive gear 965 and a second driven gear 966.

In detail, the power conversion mechanism 938 includes the second drive gear 965 that is driven to rotate by the electric motor 37, and the second driven gear 966 engaged with the second drive gear 965. The second drive gear 965 and the second driven gear 966 are, for example, bevel gears.

The second drive gear 965 is joined to the rotary shaft 44 of the electric motor 37. The second drive gear 965 and the rotary shaft 44 are disposed coaxially with each other. The second reduction gear 53 rotates together with the rotary shaft 44. The second drive gear 965 is driven to rotate around a second crossing axis L907 crossing the steering axis L3 by the electric motor 37. Specifically, the electric motor 37 is disposed so that, for example, the rotary shaft 44 extends in the front-rear direction. The motor main body 43 of the electric motor 37 is fixed to the steering case 40. The electric motor 37 is fixed to the steering shaft 611 via the steering case 40. Therefore, the second drive gear 965 is joined to the steering shaft 611 via the electric motor 37 and the steering case 40.

The second driven gear 966 includes the cylindrical portion 671 and a gear portion 972. The second driven gear 966 is fixed to the transom bracket 10 via the stay 669. The second driven gear 966 is covered by the gear case 668. The gear case 668 is disposed around the second driven gear 966. The gear portion 972 of the second driven gear 966 projects from the outer peripheral portion of the cylindrical portion 671. The gear portion 972 has, for example, a fan shape having the central axis L806 positioned on the steering axis L3. The gear portion 972 engages with the second rack 647. The rotation of the electric motor 37 is converted into turning of the steering shaft 611 around the steering axis L3 by the second drive gear 965 and the second driven gear 966.

In detail, the rotation of the electric motor 37 is transmitted to the second drive gear 965. The second driven gear 966 is fixed to the transom bracket 10, so that when the second drive gear 965 rotates around the second crossing axis L907, the position of engagement between the second drive gear 965 and the second driven gear 966 moves, and accordingly, the second drive gear 965 turns around the steering axis L3. The second drive gear 965 is joined to the steering shaft 611 via the electric motor 37 and the steering case 40. Therefore, according to turning of the second drive gear 965 around the steering axis L3, the steering shaft 611 turns around the steering axis L3 with respect to the transom bracket 10. Accordingly, the outboard motor 2 turns around the steering axis L3 with respect to the transom bracket 10.

Other Preferred Embodiments

Preferred embodiments of the present invention are as described above, however, the present invention is not limited to the contents of the first to ninth preferred embodiments described above, and can be variously changed or combined.

For example, the first to fourth and sixth to eighth preferred embodiments described above describe a case where preferably a reduction gear mechanism is provided in the steering mechanism, and the rotation of the electric motor is transmitted to a ball screw or a drive gear via the reduction gear mechanism. However, in the first to fourth and sixth to eighth preferred embodiments described above, it is also possible that the reduction gear mechanism is not provided in the steering mechanism, and the rotation of the electric motor is transmitted to a ball screw or a drive gear without the reduction gear mechanism.

The fifth and ninth preferred embodiments described above describe a case where preferably a reduction gear mechanism is not provided in the steering mechanism, and the rotation of the electric motor is transmitted to the drive gear without the reduction gear mechanism. However, in the fifth and ninth preferred embodiments, it is also possible that a reduction gear mechanism is provided in the steering mechanism, and the rotation of the electric motor is transmitted to the drive gear via the reduction gear mechanism.

A non-limiting example of the correspondence between the components mentioned in the "SUMMARY OF THE INVENTION" and the components of the above-described preferred embodiments are as follows.

Hull: Hull H1
Transom: Transom T1
Transom bracket: Transom bracket 10
Steering axis: Steering axis L3
Steering shaft: Steering shaft 11, 611
Tilt axis: Tilt axis L4
Outboard motor: Outboard motor 2
Tilt mechanism: Tilt mechanism 19
Electric motor: Electric motor 37
Power conversion mechanism: Power conversion mechanism 38, 238, 338, 438, 538, 638, 738, 838, 938
Steering mechanism: Steering mechanism 20, 220, 320, 420, 520, 620, 720, 820, 920
Marine vessel propulsion apparatus: First marine vessel propulsion apparatus 1, 201, 301, 401, 501, second marine vessel propulsion apparatus 601, 701, 801, 901
Housing portion: Housing portion 15
Reduction gear mechanism: Reduction gear mechanism 39
First conversion mechanism: First conversion mechanism 41, 641
Second conversion mechanism: Second conversion mechanism 42, 242, 342, 642, 742
First ball screw: First ball screw 45
First ball nut: First ball nut 46
First rack: First rack 47
First pinion: First pinion 48
First pin: First pin 362
First arm: First arm 363
First drive gear: First drive gear 465, 565
First driven gear: First driven gear 466, 566
First non-crossing axis: First non-crossing axis L405
First central axis: First central axis L406
First crossing axis: First crossing axis L507
Second ball screw: Second ball screw 645
Second ball nut: Second ball nut 646
Second rack: Second rack 647
Second pinion: Second pinion 648
Second pin: Second pin 762
Second arm: Second arm 763
Second drive gear: Second drive gear 865, 965
Second driven gear: Second driven gear 866, 966
Second non-crossing axis: Second non-crossing axis L805
Second central axis: Second central axis L806
Second crossing axis: Second crossing axis L907

The present application corresponds to Japanese Patent Application No. 2010-230851 filed in the Japan Patent Office on Oct. 13, 2010, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel propulsion apparatus comprising:

a transom bracket attachable to a transom of a hull, the transom bracket including a tubular housing portion extending along a steering axis that extends in an up-down direction;

a steering shaft joined to the transom bracket, the steering shaft being turnable around the steering axis;

an outboard motor joined to the steering shaft, the outboard motor being turnable around a tilt axis extending along a plane that is perpendicular or substantially perpendicular to the steering axis, the outboard motor being turnable around the steering axis together with the steering shaft;

a tilt mechanism joined to the steering shaft and the outboard motor, the tilt mechanism including a hydraulic cylinder arranged to turn the outboard motor around the tilt axis with respect to the steering shaft, a pump arranged to supply hydraulic oil to the hydraulic cylinder, and an electric tilt motor arranged to drive the pump; and a steering mechanism including an electric motor and a power conversion mechanism arranged to convert power of the electric motor into turning of the steering shaft around the steering axis; wherein at least one of the pump and the electric tilt motor is disposed outside the tubular housing portion of the transom bracket.

2. The marine vessel propulsion apparatus according to claim 1, wherein at least a portion of the steering shaft is housed in the tubular housing portion.

3. The marine vessel propulsion apparatus according to claim 1, wherein the steering mechanism includes a reduction gear mechanism arranged to decelerate rotation of the electric motor and transmit decelerated rotation to the power conversion mechanism.

4. The marine vessel propulsion apparatus according to claim 1, wherein the electric motor is arranged so as not to turn around the steering axis with respect to the transom bracket when turning the outboard motor around the steering axis, and the electric motor is arranged so as not to turn around the tilt axis with respect to the transom bracket when turning the outboard motor around the tilt axis.

5. The marine vessel propulsion apparatus according to claim 1, wherein the electric motor is arranged to change a position of the electric motor with respect to the outboard motor when turning the outboard motor around the steering axis, and the electric motor is arranged to change the position of the electric motor with respect to the outboard motor when turning the outboard motor around the tilt axis.

6. The marine vessel propulsion apparatus according to claim 4, wherein the electric motor is fixed to the transom bracket.

7. The marine vessel propulsion apparatus according to claim 1, wherein the power conversion mechanism includes a first conversion mechanism arranged to convert rotation of the electric motor into linear motion, and a second conversion mechanism arranged to convert the linear motion into turning of the steering shaft around the steering axis.

8. The marine vessel propulsion apparatus according to claim 7, wherein the first conversion mechanism includes a first ball screw joined to the transom bracket and the electric motor, the first ball screw being driven to rotate by the electric motor, and a first ball nut attached to the first ball screw;

the second conversion mechanism includes a first rack joined to the first ball nut, and a first pinion engaged with the first rack, the first pinion being joined to the steering shaft so as to turn around the steering axis together with the steering shaft; and the rotation of the electric motor is converted into linear motion of the first ball nut with respect to the first ball screw by the first ball screw and the first ball nut, and the linear motion of the first ball nut is converted into turning of the steering shaft by the first rack and the first pinion.

9. The marine vessel propulsion apparatus according to claim 7, wherein the first conversion mechanism includes a first ball screw joined to the transom bracket and the electric motor, the first ball screw being driven to rotate by the electric motor, and a first ball nut attached to the first ball screw;

the second conversion mechanism includes a first pin joined to the first ball nut, and a first arm joined to the first pin and the steering shaft, the second conversion mechanism being arranged to convert linear motion of the first ball nut with respect to the first ball screw into turning of the steering shaft by the first pin and the first arm; and the rotation of the electric motor is converted into linear motion of the first ball nut with respect to the first ball screw by the first ball screw and the first ball nut, and the linear motion of the first ball nut is converted into turning of the steering shaft by the first pin and the first arm.

10. The marine vessel propulsion apparatus according to claim 1, wherein the power conversion mechanism includes a drive gear joined to the transom bracket and the electric motor, the drive gear being driven to rotate by the electric motor, and a driven gear engaged with the drive gear, the driven gear being joined to the steering shaft so as to turn around the steering axis together with the steering shaft.

11. The marine vessel propulsion apparatus according to claim 10, wherein the drive gear is arranged to be driven to rotate by the electric motor around a non-crossing axis that is parallel or substantially parallel to the steering axis and does not cross the steering axis; and the driven gear has a central axis positioned on the steering axis, the driven gear being arranged to turn around the central axis.

12. The marine vessel propulsion apparatus according to claim 10, wherein the drive gear is arranged to be driven to rotate by the electric motor around a crossing axis crossing the steering axis; and the driven gear has a central axis positioned on the steering axis, the driven gear being arranged to turn around the central axis.

13. The marine vessel propulsion apparatus according to claim 1, wherein the electric motor is arranged to turn around the steering axis with respect to the transom bracket when turning the outboard motor around the steering axis, and the electric motor is arranged so as not to turn around the tilt axis with respect to the transom bracket when turning the outboard motor around the tilt axis.

14. The marine vessel propulsion apparatus according to claim 1, wherein the electric motor is arranged so as not to change a position of the electric motor with respect to the outboard motor when turning the outboard motor around the steering axis, and the electric motor is arranged to change the position of the electric motor with respect to the outboard motor when turning the outboard motor around the tilt axis.

15. The marine vessel propulsion apparatus according to claim 13, wherein the electric motor is fixed to the steering shaft.

16. The marine vessel propulsion apparatus according to claim 7, wherein the first conversion mechanism includes a ball screw joined to the steering shaft and the electric motor, the ball screw being driven to rotate by the electric motor, and a ball nut attached to the ball screw;

the second conversion mechanism includes a rack joined to the ball nut, and a pinion engaged with the rack, the pinion being joined to the transom bracket, the second conversion mechanism arranged to convert linear motion of the ball screw with respect to the ball nut into turning of the steering shaft by the rack and the pinion; and the rotation of the electric motor is converted into linear motion of the ball screw with respect to the ball nut by the ball screw and the ball nut, and the linear motion of the ball screw is converted into turning of the steering shaft by the rack and the pinion.

17. The marine vessel propulsion apparatus according to claim 7, wherein the first conversion mechanism includes a ball screw joined to the steering shaft and the electric motor, the ball screw being driven to rotate by the electric motor, and a ball nut attached to the ball screw;

the second conversion mechanism includes a pin joined to the ball nut, and an arm joined to the pin and the transom bracket, the second conversion mechanism being arranged to convert linear motion of the ball screw with respect to the ball nut into turning of the steering shaft by the pin and the arm; and the rotation of the electric motor is converted into linear motion of the ball screw with respect to the ball nut by the ball screw and the ball nut, and the linear motion of the ball screw is converted into turning of the steering shaft by the pin and the arm.

18. The marine vessel propulsion apparatus according to claim 1, wherein the power conversion mechanism includes a drive gear joined to the steering shaft and the electric motor, the drive gear being driven to rotate by the electric motor, and a driven gear engaged with the drive gear, the driven gear being joined to the transom bracket.

19. The marine vessel propulsion apparatus according to claim 18, wherein the drive gear is arranged to be driven to rotate by the electric motor around a non-crossing axis that is not parallel to the steering axis and does not cross the steering axis;

the driven gear has a central axis positioned on the steering axis; and the rotation of the electric motor is converted into turning of the drive gear around the central axis by the drive gear and the driven gear.

20. The marine vessel propulsion apparatus according to claim 18, wherein the drive gear is arranged to be driven to rotate by the electric motor around a crossing axis crossing the steering axis;

the driven gear has a central axis positioned on the steering axis; and the rotation of the electric motor is converted into turning of the drive gear around the central axis by the drive gear and the driven gear.

21. The marine vessel propulsion apparatus according to claim 1, wherein the hydraulic cylinder includes a tilt cylinder disposed inside the tubular housing portion of the transom bracket.

* * * * *